US011117694B2

(12) United States Patent
Fortini et al.

(10) Patent No.: US 11,117,694 B2
(45) Date of Patent: Sep. 14, 2021

(54) PACKER MACHINE AND WRAPPING METHOD TO PRODUCE A PACK OF SMOKING ARTICLES PROVIDED WITH TWO RIGID CONTAINERS INSIDE ONE ANOTHER

(71) Applicant: G.D SOCIETA' PER AZIONI, Bologna (IT)

(72) Inventors: Massimo Fortini, Granarolo Emilia (IT); Fabrizio Fazzioli, Casalecchio di Reno (IT); Gaetano Balboni, Valsamoggia (IT); Antonio Tarantino, Bologna (IT); Stefano Villa, Ozzano Emilia (IT); Luca Federici, Bologna (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 239 days.

(21) Appl. No.: 16/197,495

(22) Filed: Nov. 21, 2018

(65) Prior Publication Data

US 2019/0161221 A1 May 30, 2019

(30) Foreign Application Priority Data

Nov. 23, 2017 (IT) ..... 102017000134278

(51) Int. Cl.
*B65B 19/22* (2006.01)
*B65B 19/20* (2006.01)
*B65D 85/10* (2006.01)

(52) U.S. Cl.
CPC ..... *B65B 19/22* (2013.01); *B65B 19/20* (2013.01); *B65B 19/223* (2013.01); *B65D 85/10568* (2020.05)

(58) Field of Classification Search
CPC ..... B65B 19/20; B65B 19/22; B65B 19/223; B65D 85/10568
See application file for complete search history.

(56) References Cited

U.S. PATENT DOCUMENTS 8,123,030 B2 * 2/2012 Hein ..... B65D 85/1045 206/273
2005/0126128 A1 * 6/2005 Spatafora ..... B65B 19/226 53/466

(Continued)

OTHER PUBLICATIONS

Italian Search Report in IT 201700134278 dated Aug. 6, 2018.

*Primary Examiner* — Andrew M Tecco
*Assistant Examiner* — Nicholas E Igbokwe
(74) *Attorney, Agent, or Firm* — Marshall, Gerstein & Borun LLP

(57) ABSTRACT

A packer machine and wrapping method to produce a pack of smoking articles; the packer machine has: a first wrapping drum, which supports a first wrapping pocket, which is adapted to receive a first blank and subsequently a group of smoking articles; a first feeding station, in which the first blank is inserted into the first wrapping pocket; a first transfer station, which is arranged downstream of the first feeding station and in which the group of smoking articles is inserted into the first wrapping pocket; a second wrapping drum, which supports at least one second wrapping pocket, which is adapted to receive a second blank and subsequently an inner container, which is formed by folding the first blank; a second feeding station, in which the second blank is inserted into the second wrapping pocket; a second transfer station, which is arranged downstream of the second feeding station and in which the inner container is inserted into the second wrapping pocket; and a third wrapping drum, which supports at least one third wrapping pocket, which is adapted to directly receive the inner container from the first (Continued)

wrapping pocket in a third transfer station arranged between the first wrapping drum and the third wrapping drum and is adapted to release the inner container directly to the second wrapping pocket in the second transfer station, which is arranged between the third wrapping drum and the second wrapping drum.

24 Claims, 24 Drawing Sheets

(56) References Cited

U.S. PATENT DOCUMENTS

2010/0294622 A1* 11/2010 Graffin ..... B65G 47/847
198/470.1
2016/0332802 A1* 11/2016 D'Alfonso ..... B65D 85/1054

* cited by examiner

PACKER MACHINE AND WRAPPING METHOD TO PRODUCE A PACK OF SMOKING ARTICLES PROVIDED WITH TWO RIGID CONTAINERS INSIDE ONE ANOTHER

CROSS-REFERENCE TO RELATED APPLICATIONS

This Patent application claims priority from Italian Patent Application No. 102017000134278 filed on Nov. 23, 2017, the disclosure of which is incorporated by reference.

TECHNICAL FIELD

The present invention relates to a packer machine and to a wrapping method to produce a pack of smoking articles provided with two rigid containers one inside the other.

The present invention finds advantageous application in producing a pack of cigarettes containing a group of cigarettes, to which the following disclosure will make explicit reference without thereby losing generality.

PRIOR ART

In U.S. Pat. No. 8,123,030B2 a pack of cigarettes has been proposed, comprising a group of cigarettes, a rigid inner container having a through pull-out opening through which the cigarettes can be withdrawn, and a rigid outer container which contains the inner container and is provided with a hinged lid; preferably, a closing tab is coupled to the inner container, which is glued, by means of re-stick glue, to the inner container to cover the pull-out opening.

In U.S. Pat. No. 8,123,030B2 a packer machine has also been proposed, which produces the pack of cigarettes described above and comprises: a first wrapping drum having a vertical rotation axis (i.e. arranged horizontally), which receives a first blank and then the group of cigarettes and folds the first blank around the group of cigarettes to form the inner container, a first gluing unit that is arranged downstream of the first wrapping drum and applies glue to opposite side walls of the first container to stabilize the shape of the first container itself, a pair of first drying drums arranged downstream of the first gluing unit to allow the glue to set, a second wrapping drum having a vertical rotation axis (i.e. arranged horizontally) which receives a second blank and then the inner container and folds the second blank around the inner container to form the outer container (thus completing the formation of the pack of cigarettes), a second gluing unit which is arranged downstream of the second wrapping drum and applies glue to opposite side walls of the second container to stabilize the shape of the second container itself, and a pair of second drying drums arranged downstream of the second gluing unit to allow the glue to set.

However, the packer machine described in U.S. Pat. No. 8,123,030B2 is very bulky (i.e. it occupies a large surface area) and above all has many parts that are hard to reach (i.e. an operator cannot reach, by hand, many parts of the packer machine while standing in front of the packer machine, but in order to reach many parts of the packer machine by hand one must somehow "enter" the packer machine by making demanding and tiring "contortions"). Consequently, assembly and above all maintenance and periodic cleaning of the packer machine described in U.S. Pat. No. 8,123,030B2 are extremely laborious and particularly long (with a consequent extremely long maintenance and cleaning down-time of the machine and therefore clearly detrimental to the average productivity of the packer machine in the long run).

Moreover, the packer machine described in the U.S. Pat. No. 8,123,030B2 is adapted to operate only with an intermittent motion (i.e. a motion that cyclically alternates stopping steps and motion steps) and then subjects the mechanics to continuous accelerations/decelerations which do not allow a high hourly productivity to be obtained (i.e. a large number of packs of cigarettes produced per time unit) while maintaining an optimal production quality.

DESCRIPTION OF THE INVENTION

The object of the present invention is to provide a packer machine and a wrapping method to produce a pack of smoking articles provided with two rigid containers one inside the other, which packer machine and wrapping method are free from the drawbacks described above and are, at the same time, easy and inexpensive to produce.

According to the present invention, a packer machine and a wrapping method are provided to produce a pack of smoking articles provided with two rigid containers one inside the other, according to what is claimed in the attached claims.

The claims describe preferred embodiments of the present invention forming an integral part of the present disclosure.

BRIEF DESCRIPTION OF THE DRAWINGS

The present invention will now be described with reference to the attached drawings, which illustrate an example of non-limiting embodiment, wherein.

PREFERRED EMBODIMENTS OF THE INVENTION

Figure 2:
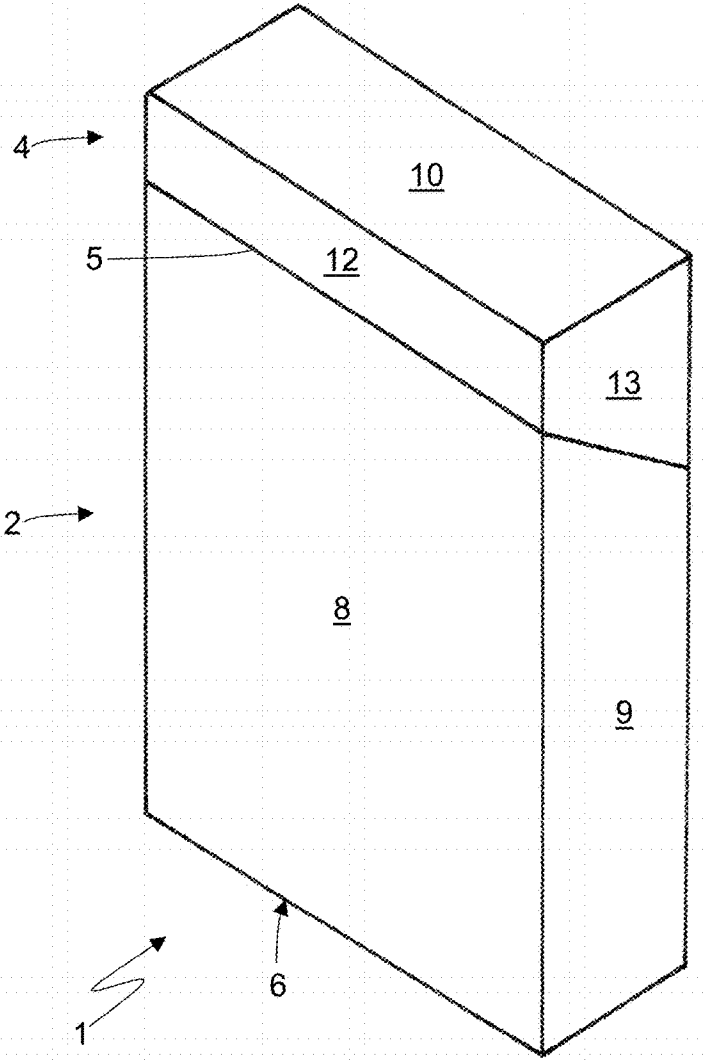
FIG. 2 is a rear perspective view of the pack of cigarettes of FIG. 1 in a closed configuration.
Figure 1:
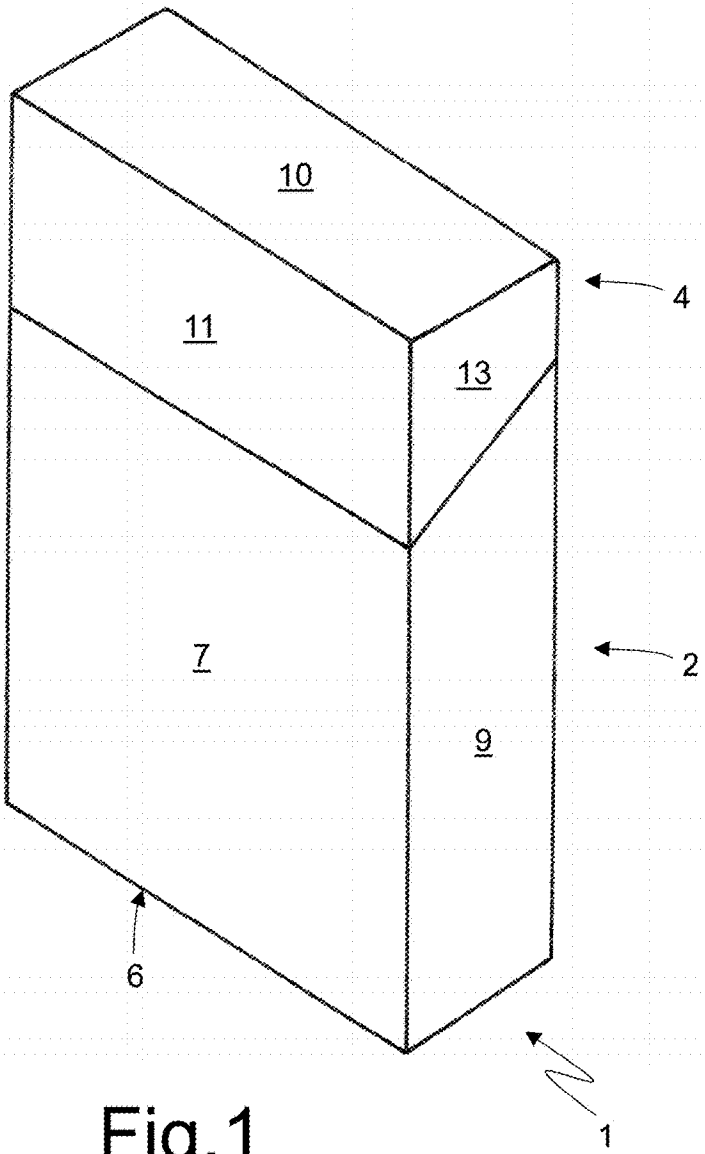
FIG. 1 is a front perspective view and in a closed configuration of a pack of cigarettes provided with two rigid containers one inside the other.
Figure 3:
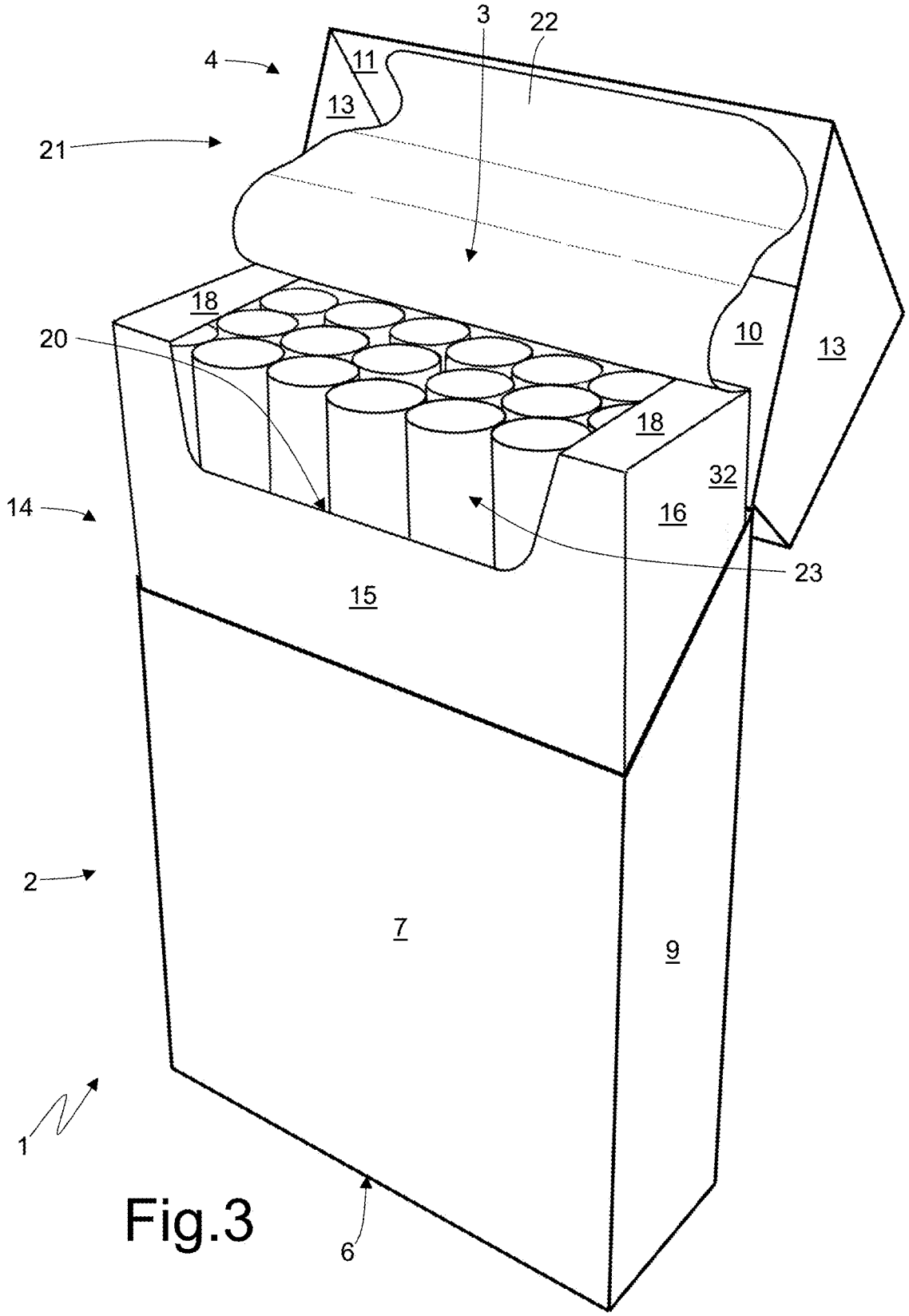
FIG. 3 is a front perspective view of the pack of cigarettes of FIG. 1 in an open configuration.

In FIGS. 1, 2 and 3 number 1 denotes, as a whole, a rigid pack of cigarettes. The pack 1 of cigarettes comprises an outer container 2 made of a cup-shaped rigid cardboard or paperboard.

The outer container 2 has an open upper end 3 and is provided with a lid 4, which is cup-shaped and is hinged to the outer container 2 along a hinge 5 (illustrated in FIG. 2) to rotate relative to the outer container 2, between an open position (illustrated in FIG. 3) and a closed position (illustrated in FIGS. 1 and 2) of the open upper end 3. The outer container 2 has a substantially rectangular parallelepiped shape orientated in a prevalently vertical development direction, is cup-shaped, and has the open upper end 3, a lower wall 6 opposite the open upper end 3, a front wall 7 and a rear wall 8 (where the hinge 5 is obtained) parallel and opposite to one another, and two side walls 9 parallel and opposite to each other. Between the front 7, rear 8 and side 9 walls of the outer container 2, four longitudinal edges are defined, whereas between the walls 7, 8 and 9 and the lower wall 6 of the outer container 2, four transverse edges are defined.

The lid 4 has a substantially rectangular parallelepiped shape, is cup-shaped, and has an open lower end (facing the open upper end 3 of the outer container 2 when the lid 4 is in the closed position), an upper wall 10 (which is parallel and opposite to the lower wall 6 of the outer container 2 when the lid 4 is in the closed position), a front wall 11 (which is parallel to and aligned with the front wall 7 of the outer container 2 when the lid 4 is in the closed position) a rear wall 12 (which is parallel to and aligned with the rear wall 8 of the outer container 2 when the lid 4 is in the closed position and is hinged to the rear wall 8 of the outer container 2 along the hinge 5), and two side walls 13 parallel and opposite to each other (which are parallel and aligned, in particular coplanar and adjacent, to the side walls 9 of the outer container 2 when the lid 4 is in the closed position). Between the front 11, rear 12 and side 13 walls of the lid 4, four longitudinal edges are defined, whereas between the walls 11, 12 and 13 and the upper wall 10 of the lid 4, four transverse edges are defined. The longitudinal edges and transverse edges of the lid 4 are parallel to and aligned with the corresponding longitudinal and transverse edges of the outer container 2 when the lid 4 is in the closed position.

Figure 4:
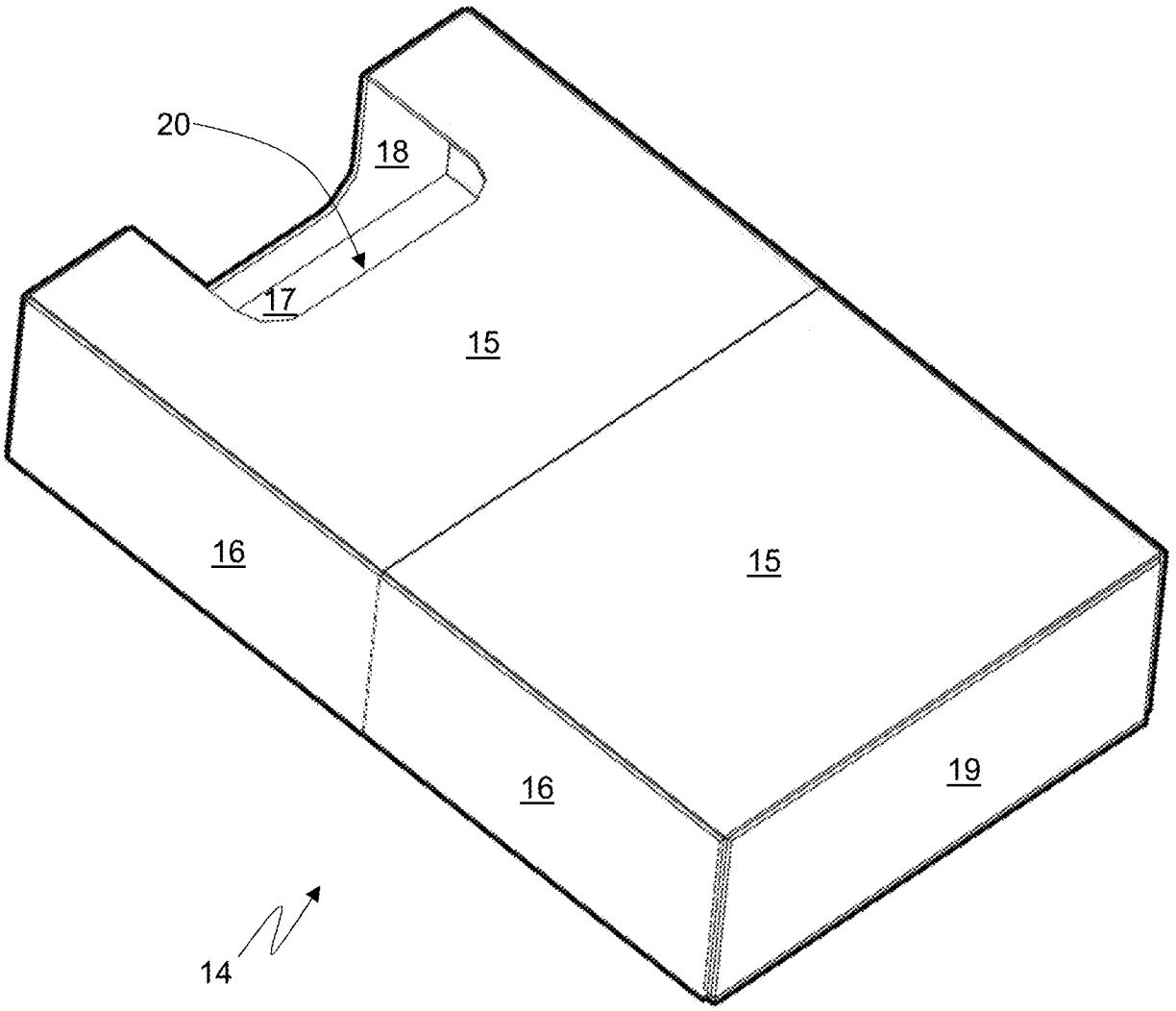
FIG. 4 is a front perspective view of an inner container of the pack of FIG. 1.

As illustrated in FIGS. 3 and 4, the pack 1 of cigarettes comprises an inner container 14, which is fixed (normally by gluing) to the inside of the outer container 2 to partially protrude to the outside of the open upper end 3 and to engage a corresponding inner surface of the lid 4 when the lid 4 itself is arranged in said closed position. The inner container 14 comprises a front wall 15, which is parallel to and rests against the front wall 7 of the container 2, two side walls 16 which are folded by 90° relative to the front wall 15 and are parallel to and rest against the side walls 9 of the container 2, a rear wall 17 which is folded by 90° relative to the side walls 16, is parallel to the front wall 15 and is parallel to, rests against and is glued to the rear wall 8 of the container 2, an upper wall 18 which is perpendicular to the walls 15, 16 and 17, and a lower wall 19 which is parallel and opposite to the upper wall 18, is perpendicular to the walls 15, 16 and 17, and is parallel to and rests against the lower wall 6 of the container 2.

The inner container 14 also has the function of keeping the lid 4 in the closed position with a given force to avoid undesired openings of the lid 4; said "locking" function of the lid 4 in the closed position is carried out due to the fact that when the lid 4 is in the closed position the inner container 14 partially protrudes from the open end of the container 2 and thus engages a corresponding inner surface of the lid 4: in this way, to open the lid 4 it is necessary to elastically and slightly deform the lid 4 and/or the inner container 14 and therefore it is necessary to apply a given force to the lid 4 to open the lid 4.

The inner container 14 has a pull-out opening 20 which is arranged at the centre and involves a portion of the front wall 15 of the inner container 14 and a portion of the upper wall 18 of the inner container 14. The pull-out opening 20 is formed by making a closed-shaped through incision through the inner container 14 which internally delimits a disposable portion of the inner container 14 which is removed, so as to leave a hole (which forms the extraction opening 20).

According to what is illustrated in FIG. 3, the extraction opening 20 of the inner container 14 is normally closed by a reusable closing tab 21 which is fixed to the inner container 14 by means of the re-stick glue which is arranged around the pull-out opening 20 to allow the closing tab 21 to be (i.e. at each opening of the pack 1 of cigarettes) partially separated from the inner container 14 several times and then fixed again to the inner container 14 (at each closing of the pack 1 of cigarettes). In other words, the re-stick glue is a glue that does not dry after its application and therefore allows the separation and subsequent re-adhesion of the closing tab 21 to the underlying inner container 14 to be repeated several times.

The closing tab 21 is provided with a connecting flap 22, which is glued in a permanent and non-separable manner to the inner surface of the front wall 11 of the lid 4 by means of the permanent glue 26 (illustrated in FIG. 8) which is applied to the outer surface 27 of the closing tab 21 (i.e. to the surface of the closing tab 21 facing outwards, i.e. from the opposite wall of the inner container 14). In this way, by opening or closing the lid 4, the closing tab 21 is simultaneously opened and closed as well.

In the (non-limiting) embodiment illustrated in the attached Figures, the outer surface of the connecting flap 22 of the closing tab 21 is glued in a permanent and not separable manner to the inner surface of the front wall 11 of the lid 4 by permanent glue so that, by opening and closing the lid 4, the closing tab 21 is simultaneously and automatically opened and closed as well.

Figure 5:
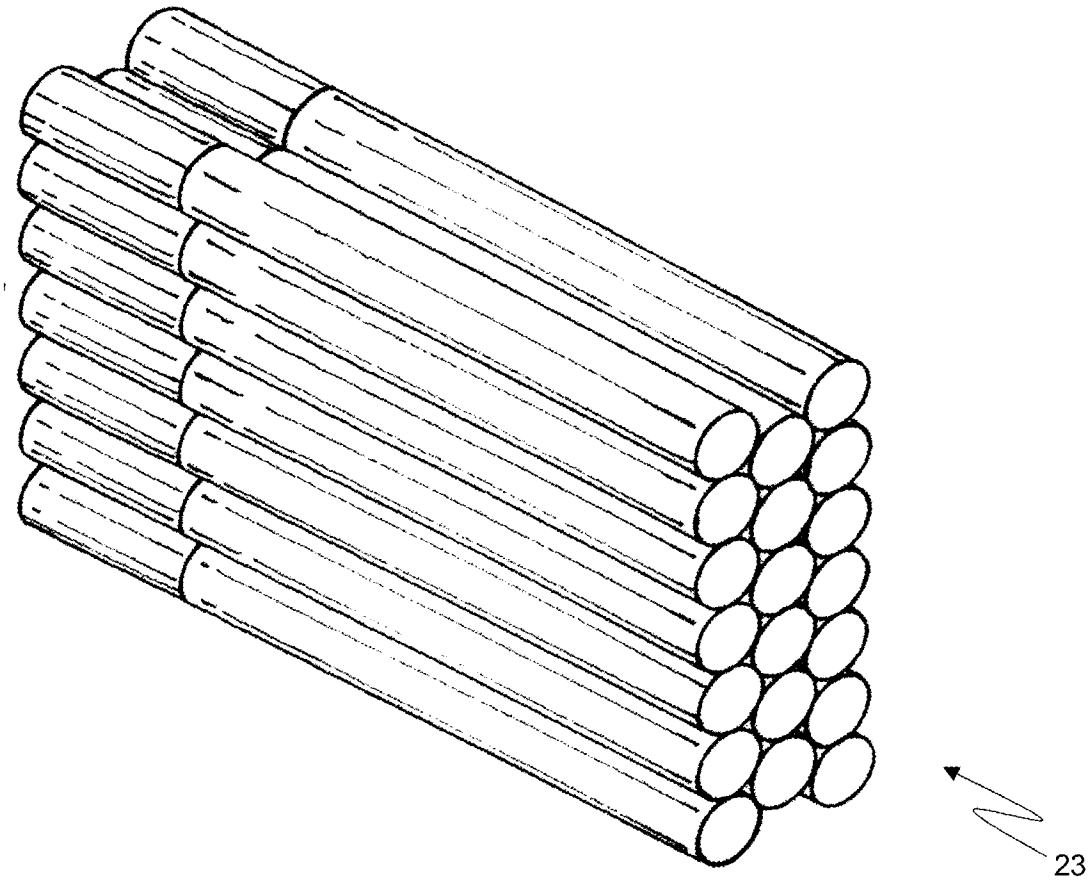
FIG. 5 is a perspective view of a group of cigarettes contained in the inner container of FIG. 4.

As illustrated in FIG. 3, a group 23 of cigarettes is arranged (illustrated in its entirety in FIG. 5) inside the container 14. According to the embodiment illustrated in the attached Figures, the group 23 of cigarettes is devoid of inner wrap and is in direct contact with the inner container 14; i.e. the group 23 of cigarettes is "naked" and therefore it is completely devoid of an inner wrap that wraps the same and, is inserted into the inner container 14 exactly as illustrated in FIG. 5. According to a different embodiment not illustrated, the group 23 of cigarettes is wrapped in an inner wrap that is cup-shaped, leaving the upper part of the cigarettes completely in sight (i.e. the filters of the cigarettes), and therefore is "invisible" from the outside of the inner container 14; according to a further embodiment not illustrated, the group 23 of cigarettes is wrapped in an inner wrap which completely covers the group 23 of cigarettes and is provided with a removable upper portion (the so-called "pull") which must be removed at the first opening of the pack 1 of cigarettes.

Figure 6:
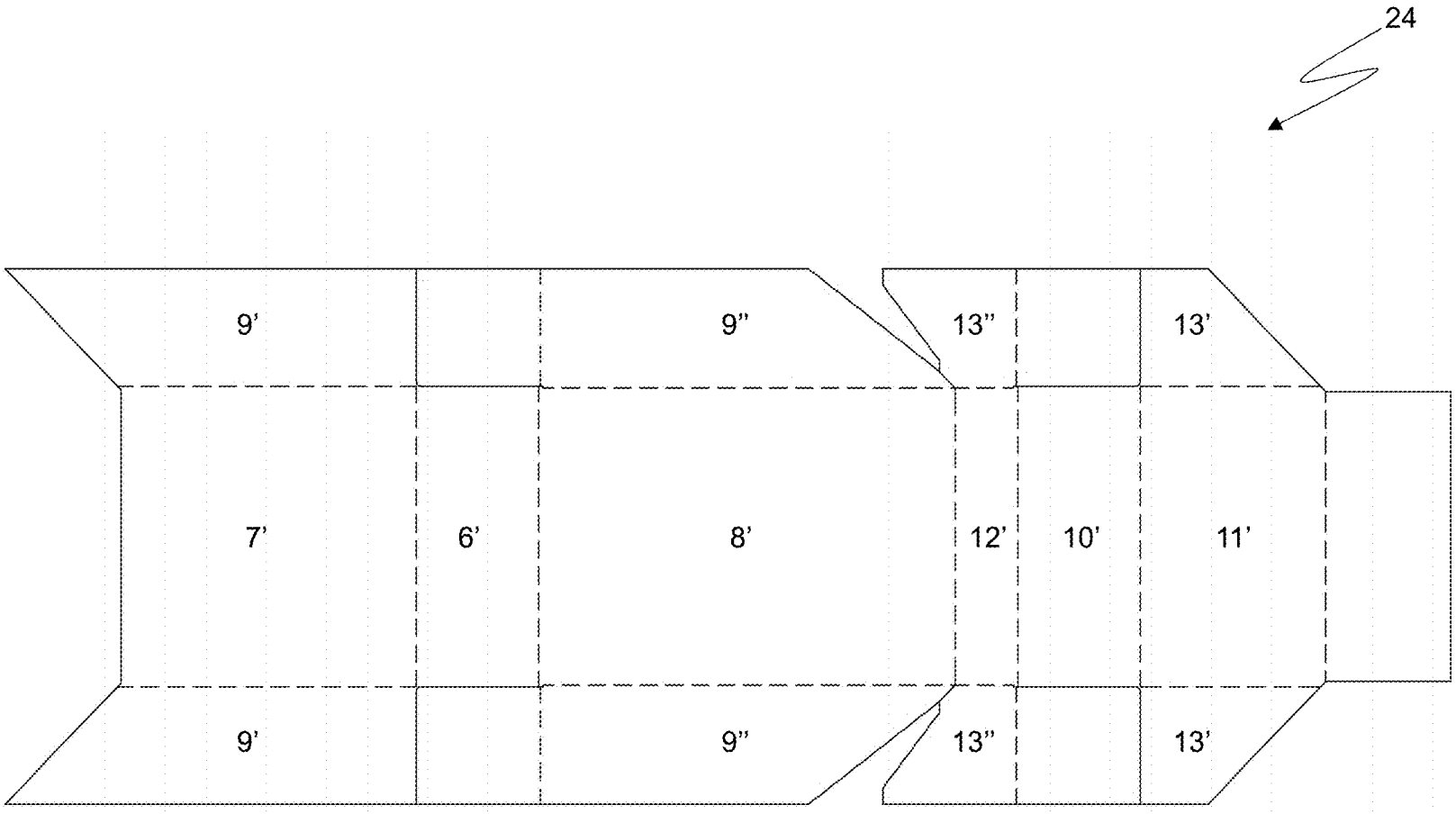
FIG. 6 is a plan view of a blank used to produce an outer container provided with a hinged lid of the pack of cigarettes of FIG. 1.

According to what is illustrated in FIG. 6, the outer container 2 and the lid 4 are formed by folding a blank 24 of a conventional type.

Figure 7:
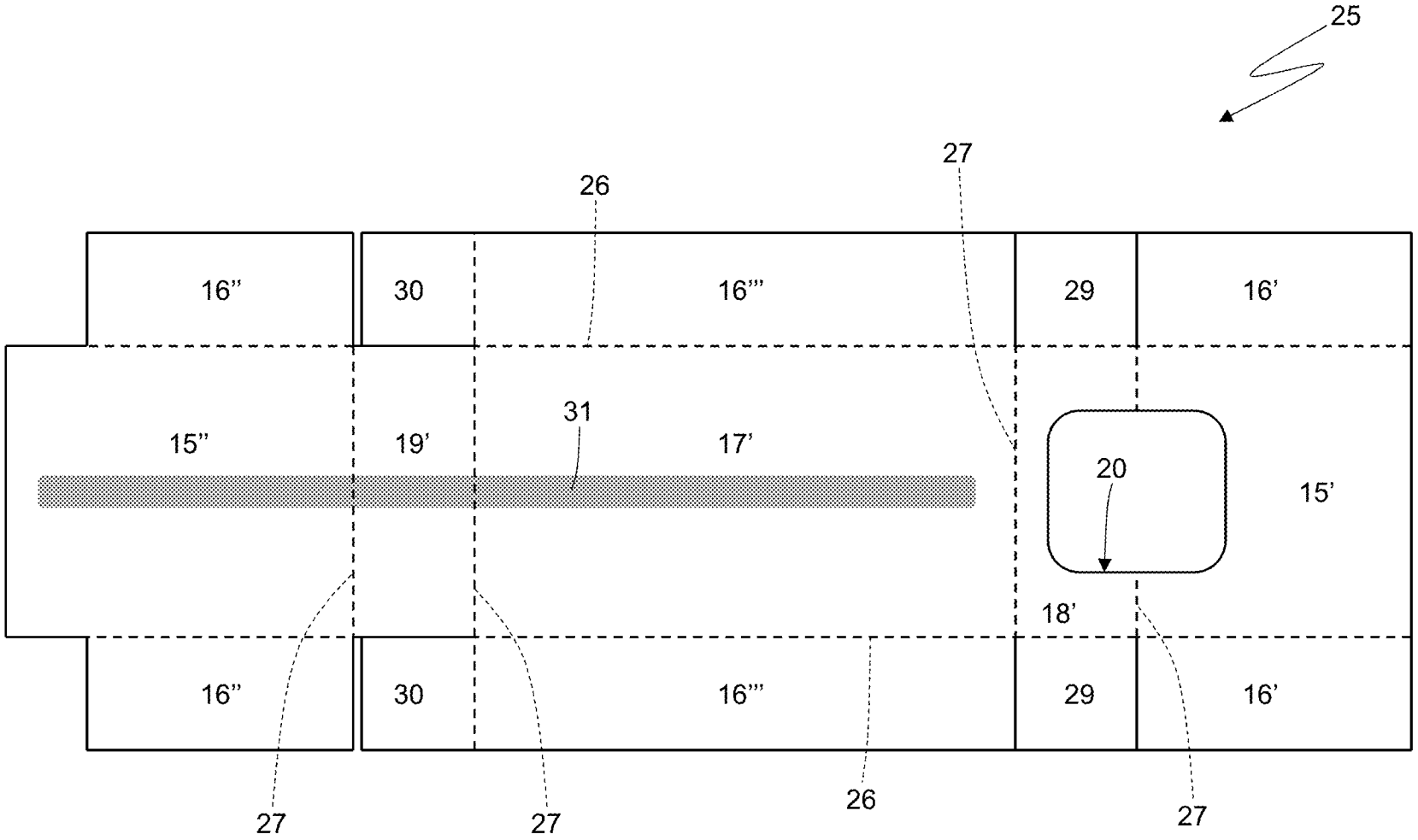
FIG. 7 is a plan view of a blank used to produce the inner container of FIG. 4.

According to what is illustrated in FIG. 7, the inner container 14 is formed by folding a blank 25. The blank 25 comprises two longitudinal folding lines 26 and a plurality of transverse folding lines 27 which define, between the two longitudinal folding lines 26, a panel 15' which makes up the upper part of the front wall 15 of the inner container 14, a panel 18' which makes up the upper wall 18 of the inner container 14, a panel 17' which makes up the rear wall 17 of the inner container 14, a panel 19' which makes up the lower wall 19 of the inner container 14, and a panel 15" which makes up the lower part of the front wall 15 of the inner container 14.

According to a preferred, but not binding, embodiment, the panel 15' partially overlaps the panel 15" to form the front wall 15 of the inner container 14; as clearly illustrated in FIG. 7, there is an overlapping band in which the lower portion of the panel 15' is resting on top of the upper portion of the panel 15". According to other embodiments not illustrated, the lower edge of the panel 15' is flush with the upper edge of the panel 15" or, alternatively, the lower edge of the panel 15' is spaced apart from the upper edge of the panel 15".

The blank 25 comprises a pair of wings 16', which are arranged on opposite sides of the panel 15', are connected to the panel 15' along the two longitudinal folding lines 26 and make up part of the side walls 16 of the inner container 14. The blank 25 comprises a pair of wings 16''', which are arranged on opposite sides of the panel 17', are connected to the panel 17' along the two longitudinal folding lines 26, make up part of the side walls 16 of the inner container 14, and overlap the corresponding wings 16' to form part of the side walls 16 of the inner container 14. The blank 25 comprises a pair of wings 16", which are arranged on opposite sides of the panel 15", are connected to the panel 15" along the two longitudinal folding lines 26, make up part of the side walls 16 of the inner container 14, and overlap the corresponding wings 16''' to form part of the side walls 16 of the inner container 14.

The blank 25 comprises a pair of wings 29, which are arranged on opposite sides of the panel 18', are connected to the panel 18' along the two longitudinal folding lines 26 and are folded by 90° relative to the panel 18' to rest against the wings 16'''. The blank 25 comprises a pair of wings 30, which are arranged on opposite sides of the panel 19', are connected to the corresponding wings 16''' along a transverse folding line 27 and are folded by 90° relative to the corresponding wings 16''' to rest against the panel 19'.

In the (non-binding) embodiment illustrated in the attached Figures, the inner container 14 is internally devoid of glue (i.e. no glue is used to connect parts of the inner container 14 to one another) and the inner container 14 is glued to the outer container 2 only by means of permanent glue 31 (i.e. of a glue that dries after its application thus providing a strong and non-separable bond, except by means of a violent and destructive tear). In other words, throughout the inner container 14 the only permanent glue that is applied is the permanent glue 31 which only serves to join the inner container 14 to the outer container 2. In the embodiment illustrated in FIG. 15, the permanent glue 31 is arranged at the rear wall 17 of the inner container 14 (i.e. at the rear wall 8 of the outer container 2), of the lower wall 19 of the inner container 14 (i.e. at the lower wall 6 of the outer container 2), and of the front wall 15 of the inner container 14 (i.e. at the front wall 7 of the outer container 2). According to other equivalent embodiments, the permanent glue 31 may also not be provided (i.e. the inner container 14 is not glued to the outer container 2) or the permanent glue 31 could be applied differently than what illustrated in FIG. 7. It is important to note that preferably the permanent glue 31 (interposed between the inner container 14 and the outer container 2) is initially applied to the blank 24 (i.e. to the outer container 2) and not to the blank 25 (i.e. to the inner container 14).

With reference to FIGS. 8-14, the folding sequence of the blank 25 to produce the inner container 14 is described in the following.

Figure 8:
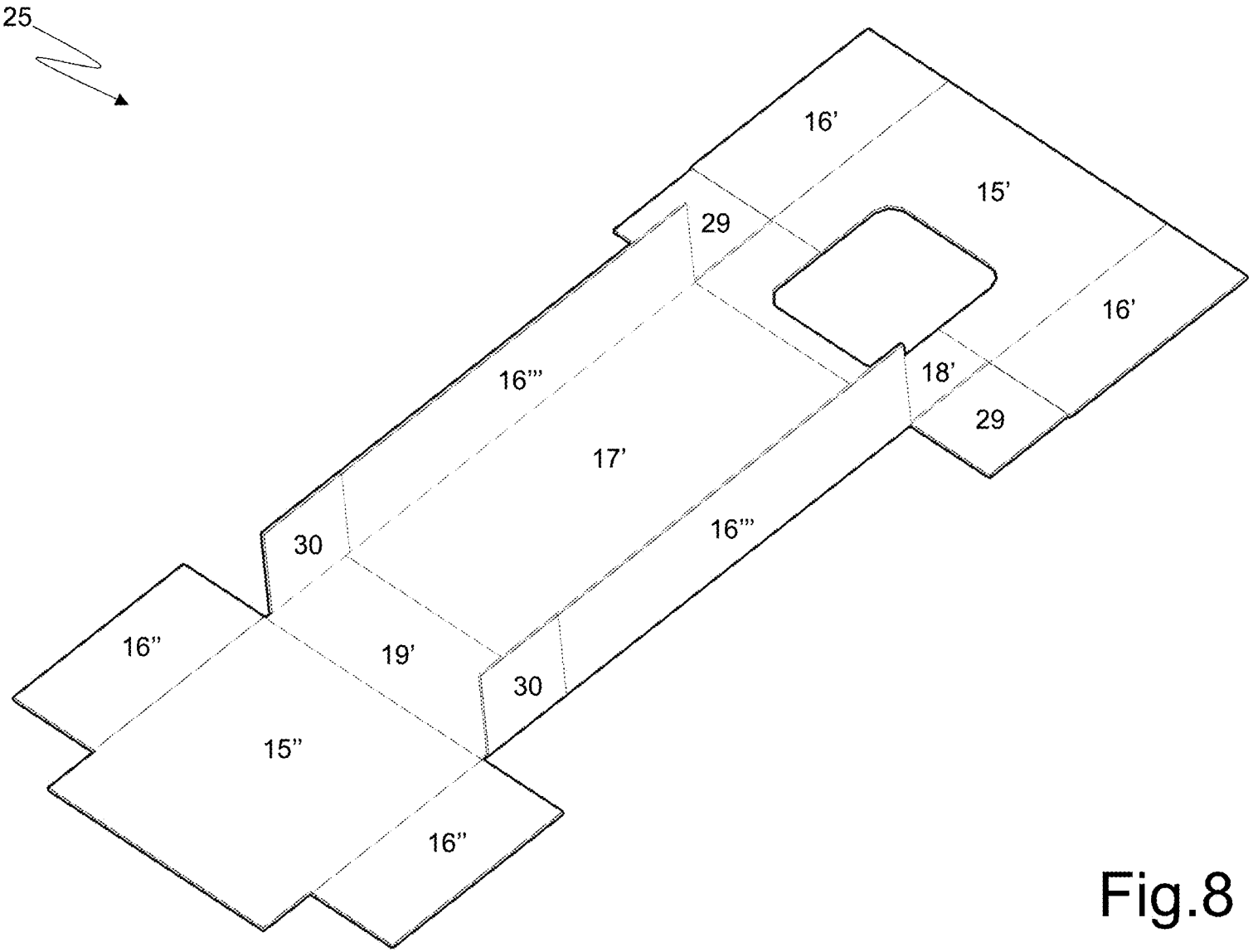
FIGS. 8-14 illustrate a perspective view of the folding of the blank of FIG. 7 to produce the inner container of FIG. 4.

Initially and as illustrated in FIG. 8, the wings 16''' (to which the wings 30 are connected) are folded by 90° relative to the panel 17'.

Figure 9:
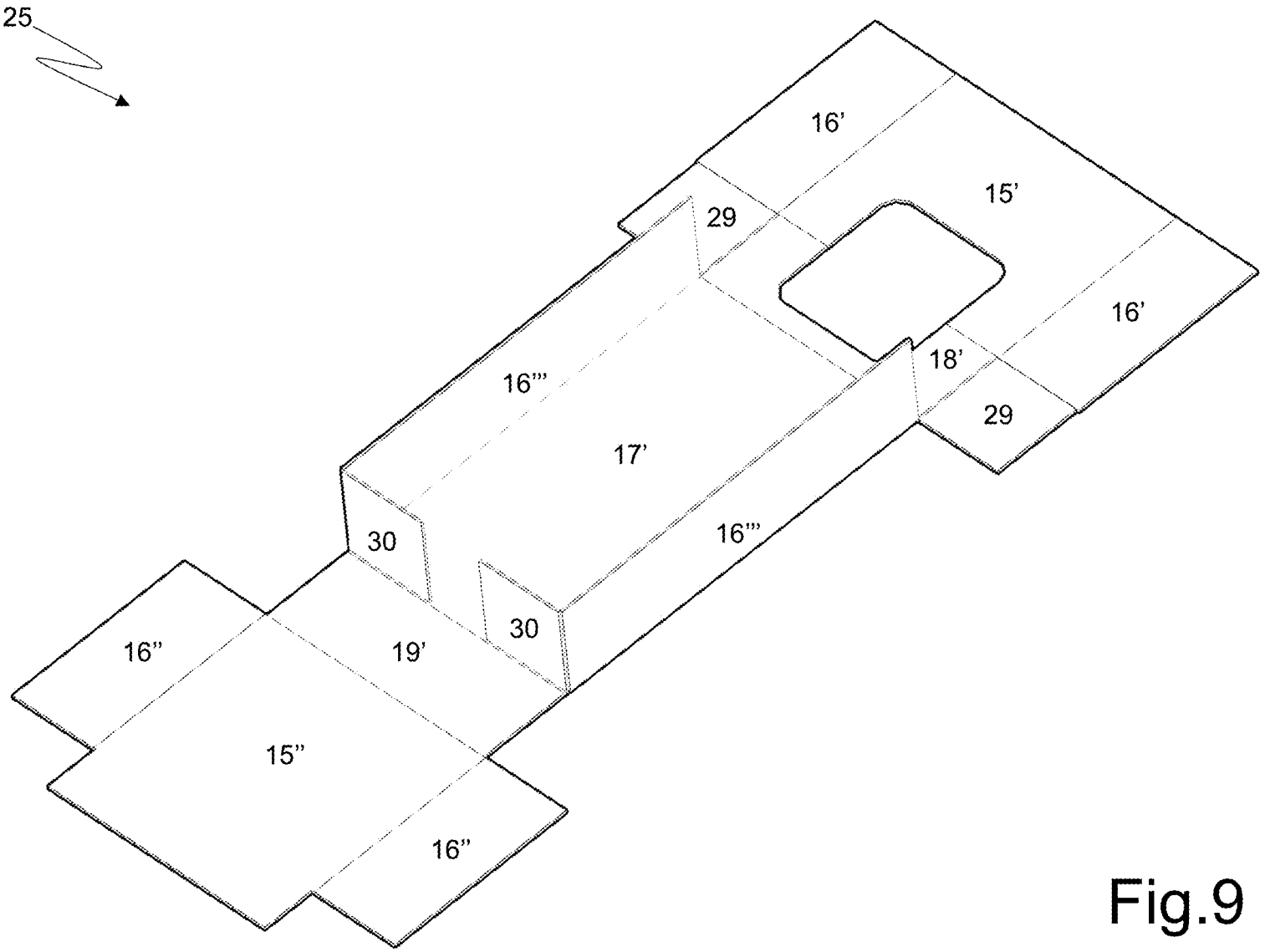
Figure 10:
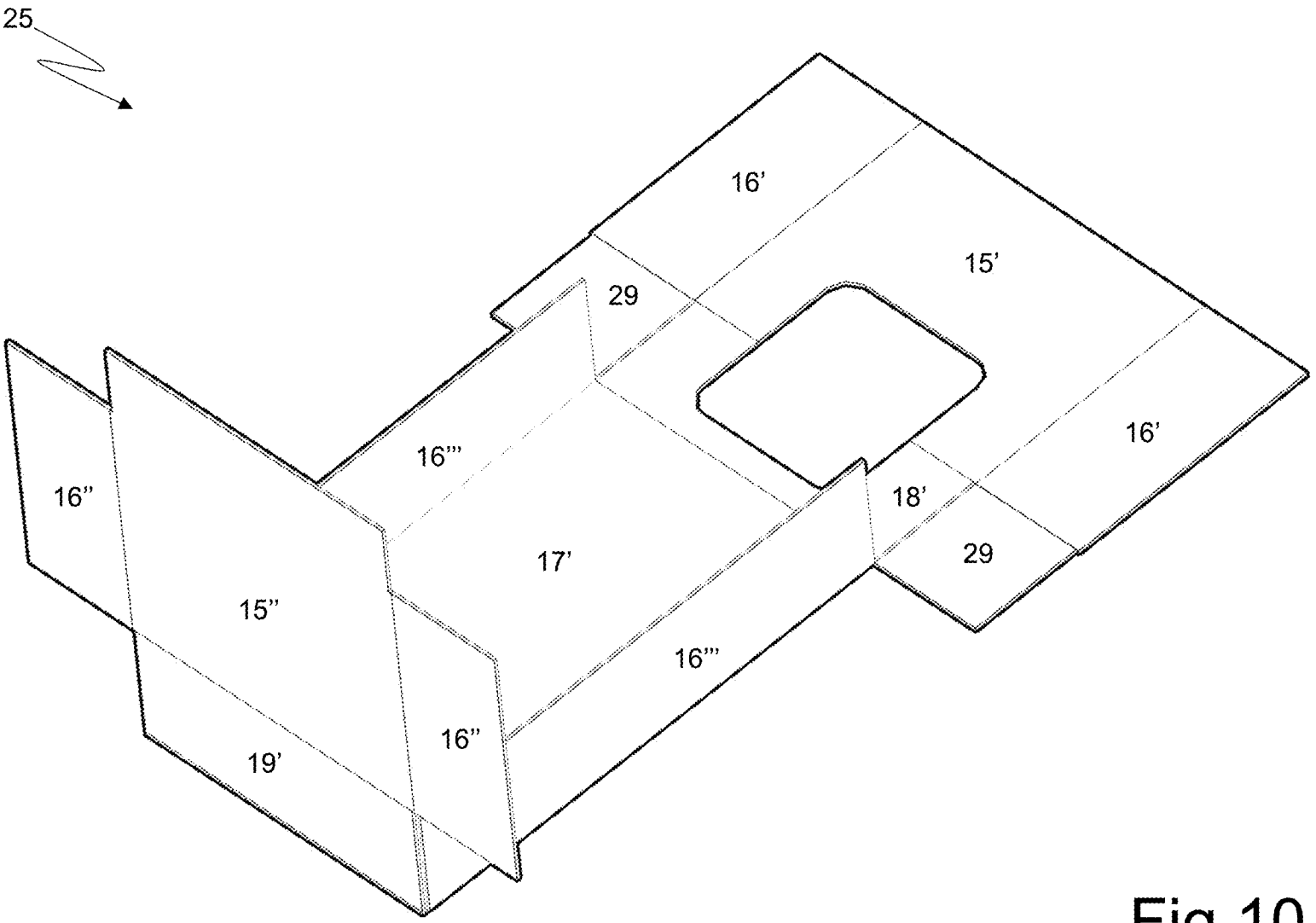

Subsequently and as illustrated in FIG. 9, the wings 30 are folded by 90° relative to the corresponding wings 16'''. Subsequently and as illustrated in FIG. 10, the panel 19' (to which the panel 15", provided with the wings 16", is connected) is folded by 90° relative to the panel 17'; in this way the panel 19' rests against the two previously folded wings 30 and the panel 15", provided with the wings 16", is arranged perpendicular to the panel 17'.

Figure 11:
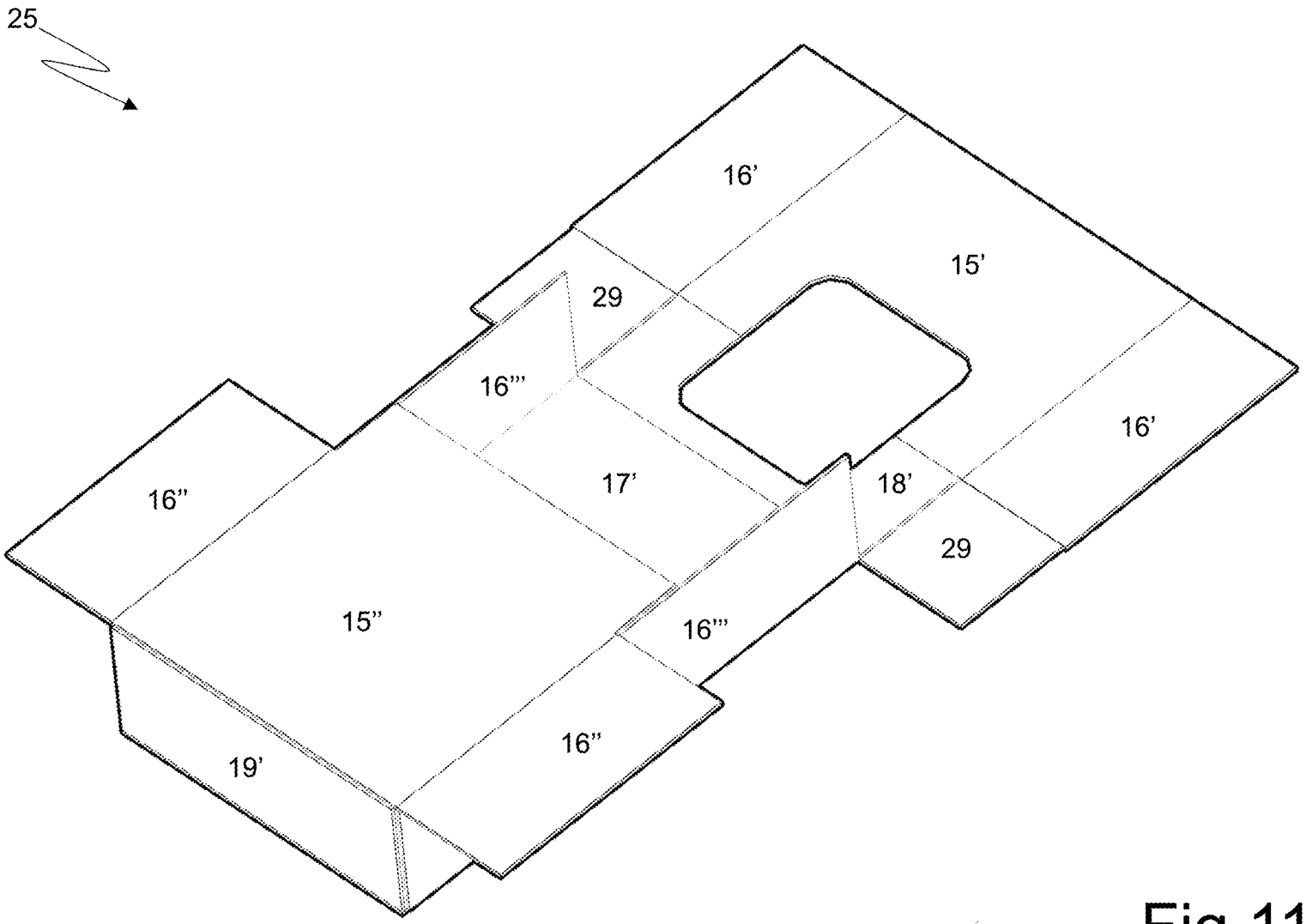

Subsequently and as illustrated in FIG. 11, the panel 15" provided with the wings 16" is folded by 90° relative to the panel 19'; in this way the panel 15", provided with the wings 16", is arranged parallel to the panel 17'.

Figure 12:
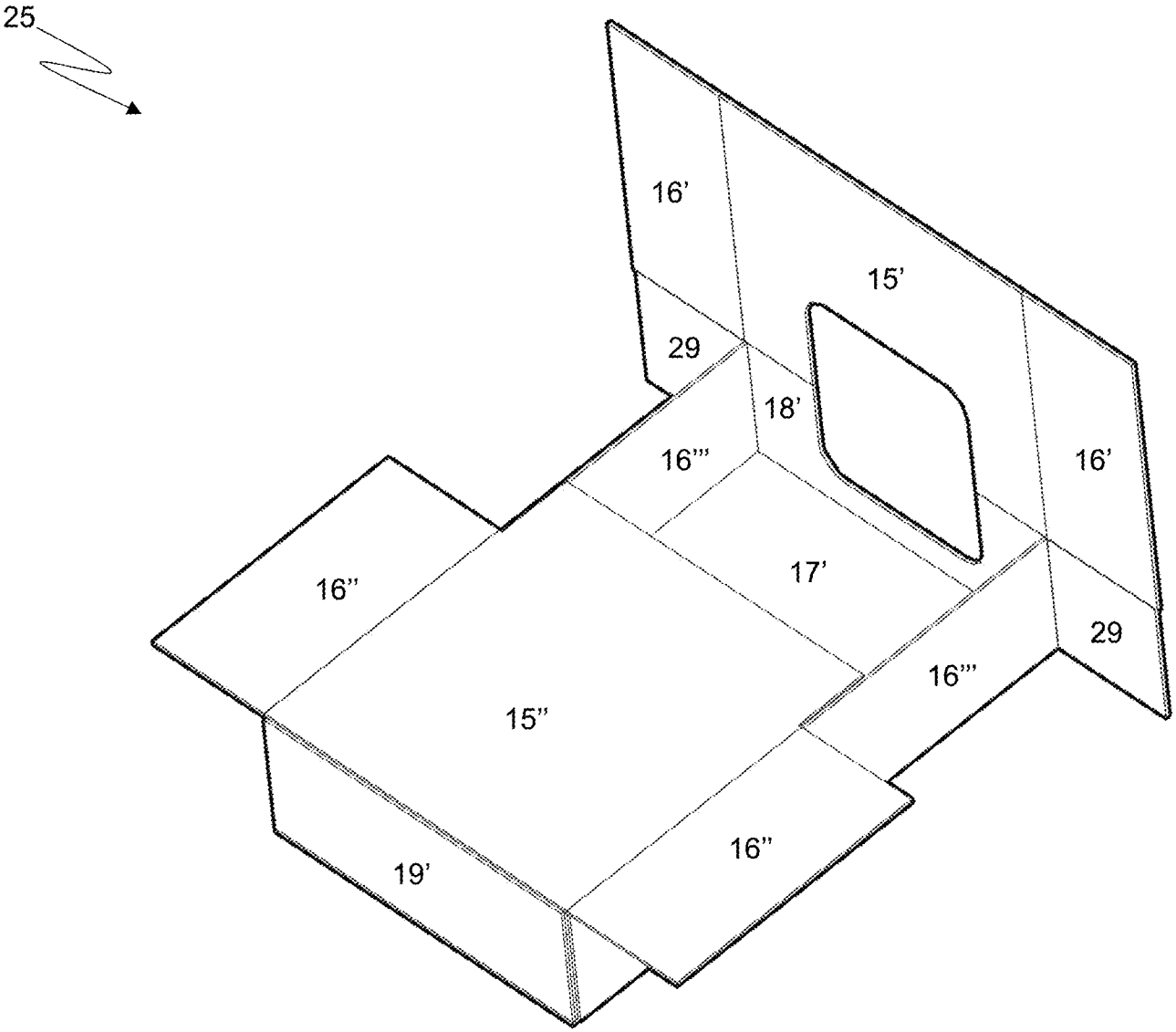

Subsequently and as illustrated in FIG. 12, the panel 18' (provided with the wings 29 and to which the panel 15', provided with the wings 16', is connected) is folded by 90° relative to the panel 17'; in this way the panel 15', provided with the wings 16', is arranged perpendicular to the panel 17'.

Figure 13:
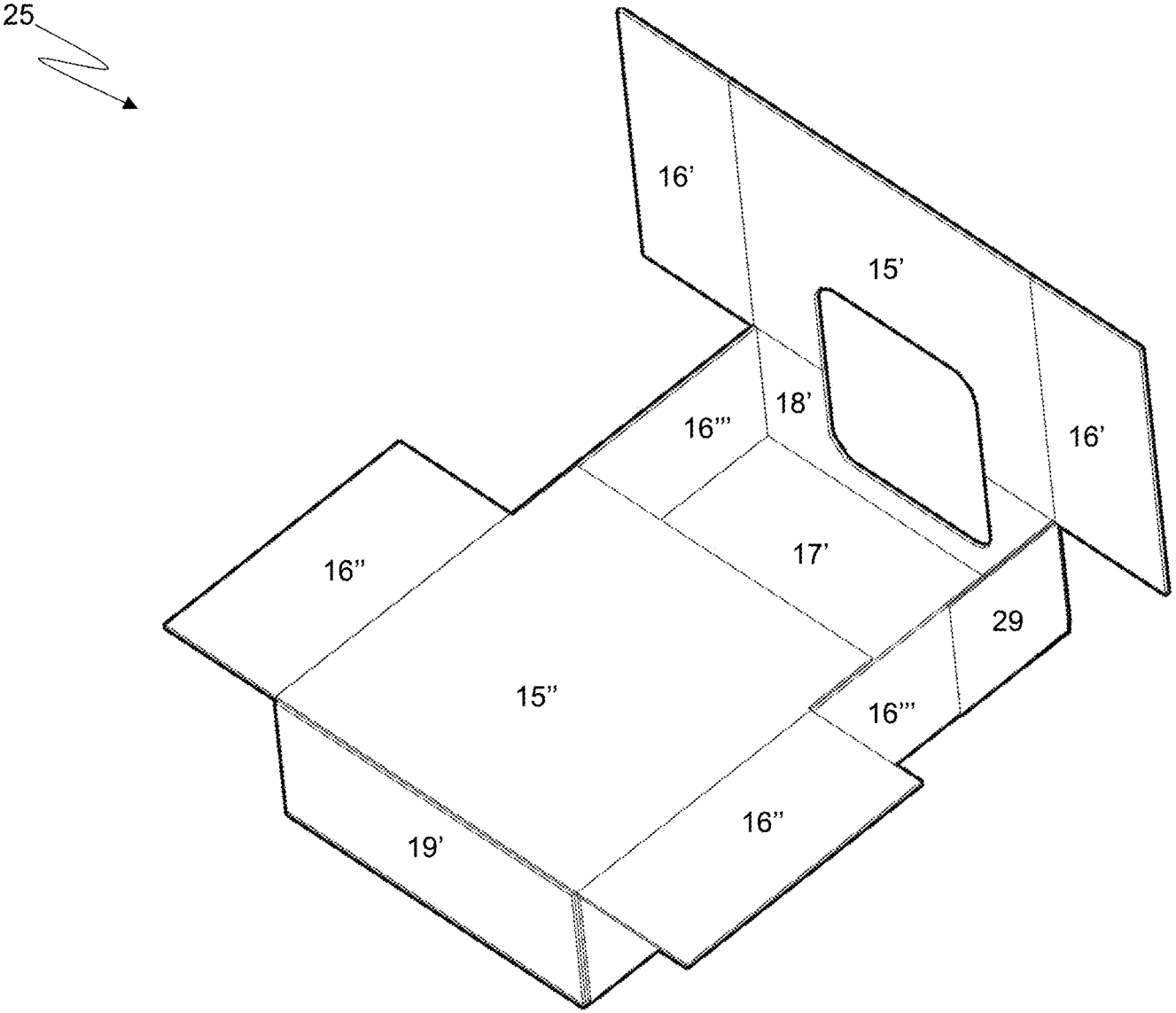

Subsequently and as illustrated in FIG. 13, the wings 29 are folded by 90° relative to the panel 18' and against the wings 16'''.

Figure 14:
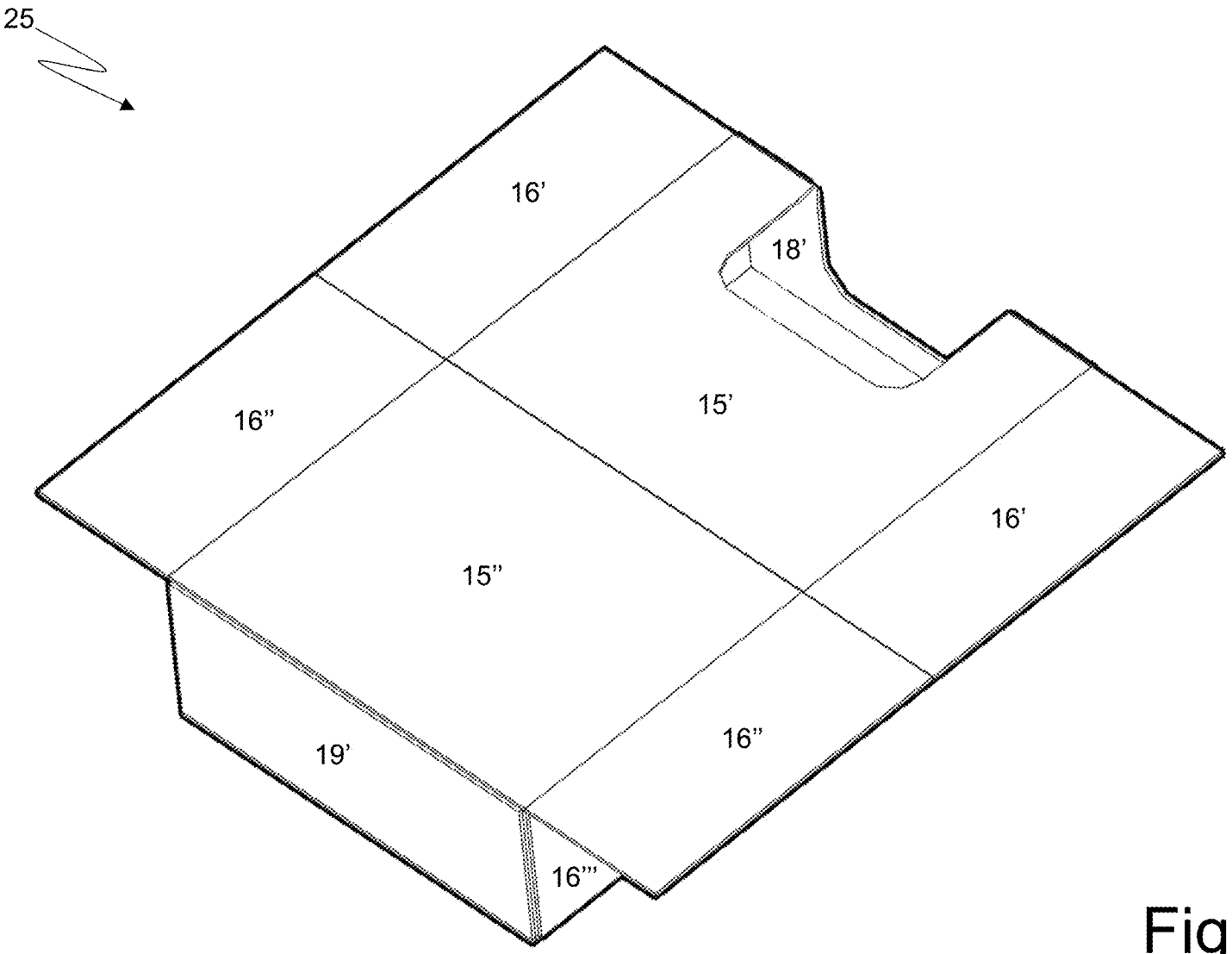

Subsequently and as illustrated in FIG. 14, the panel 15' provided with the wings 16' is folded by 90° relative to the panel 18' and partially above the panel 15"; in this way the panel 15', provided with the wings 16', is arranged parallel to the panel 17'.

Finally, the wings 16' are folded by 90° relative to the panel 15' and against the wings 16''' and, at the same time, the wings 16" are folded by 90° relative to the panel 15" and against the wings 16''' to complete the formation of the inner container 14.

Figure 15:
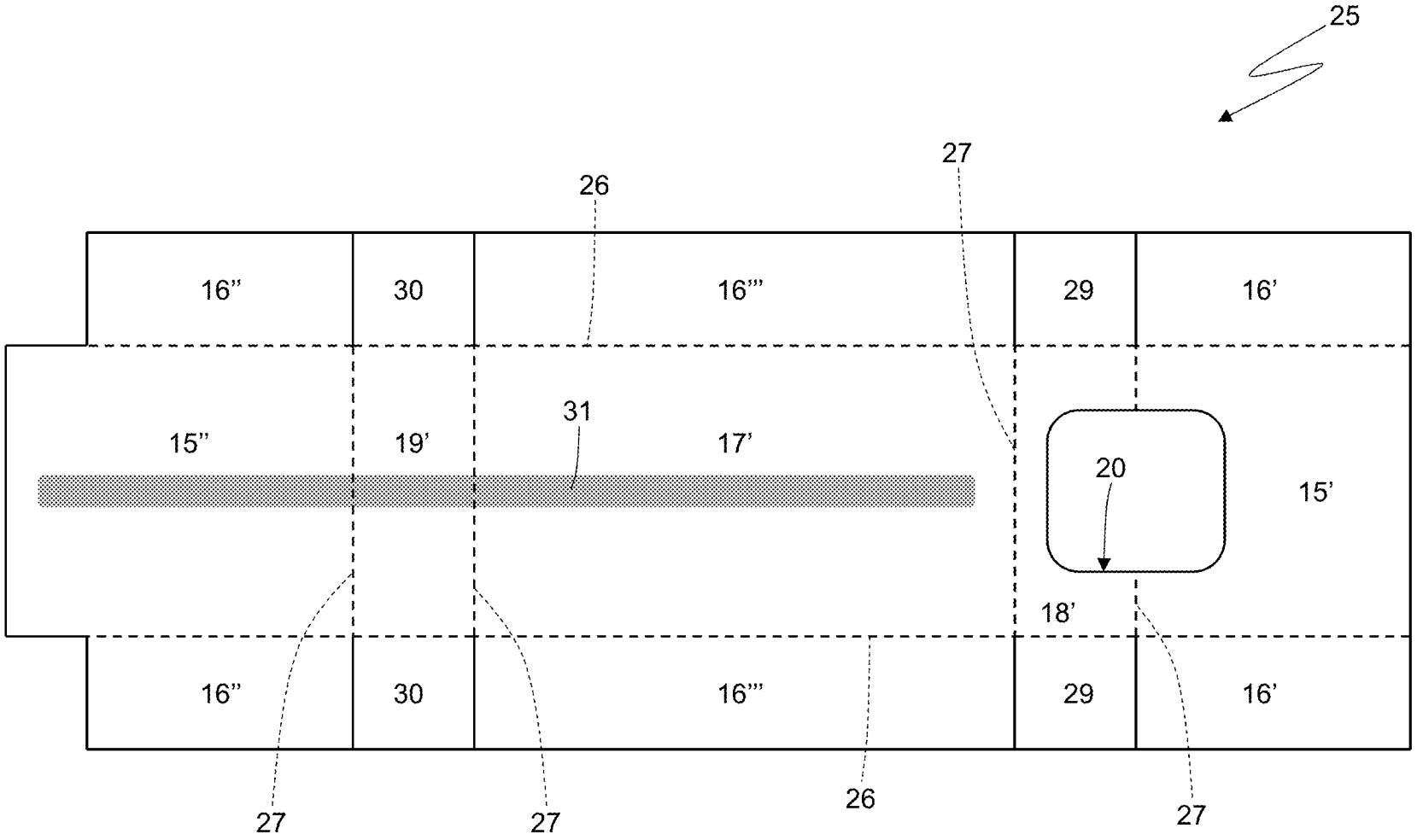
FIG. 15 is a plan view of an alternative of the blank of FIG. 7.

In the alternative of the blank 25 illustrated in FIG. 15, the wings 30 are arranged on opposite sides of the panel 19', are connected to the panel 19' along the two longitudinal folding lines 26 and are folded by 90° relative to the panel 19' to rest against the wings 16'''.

Figure 16:
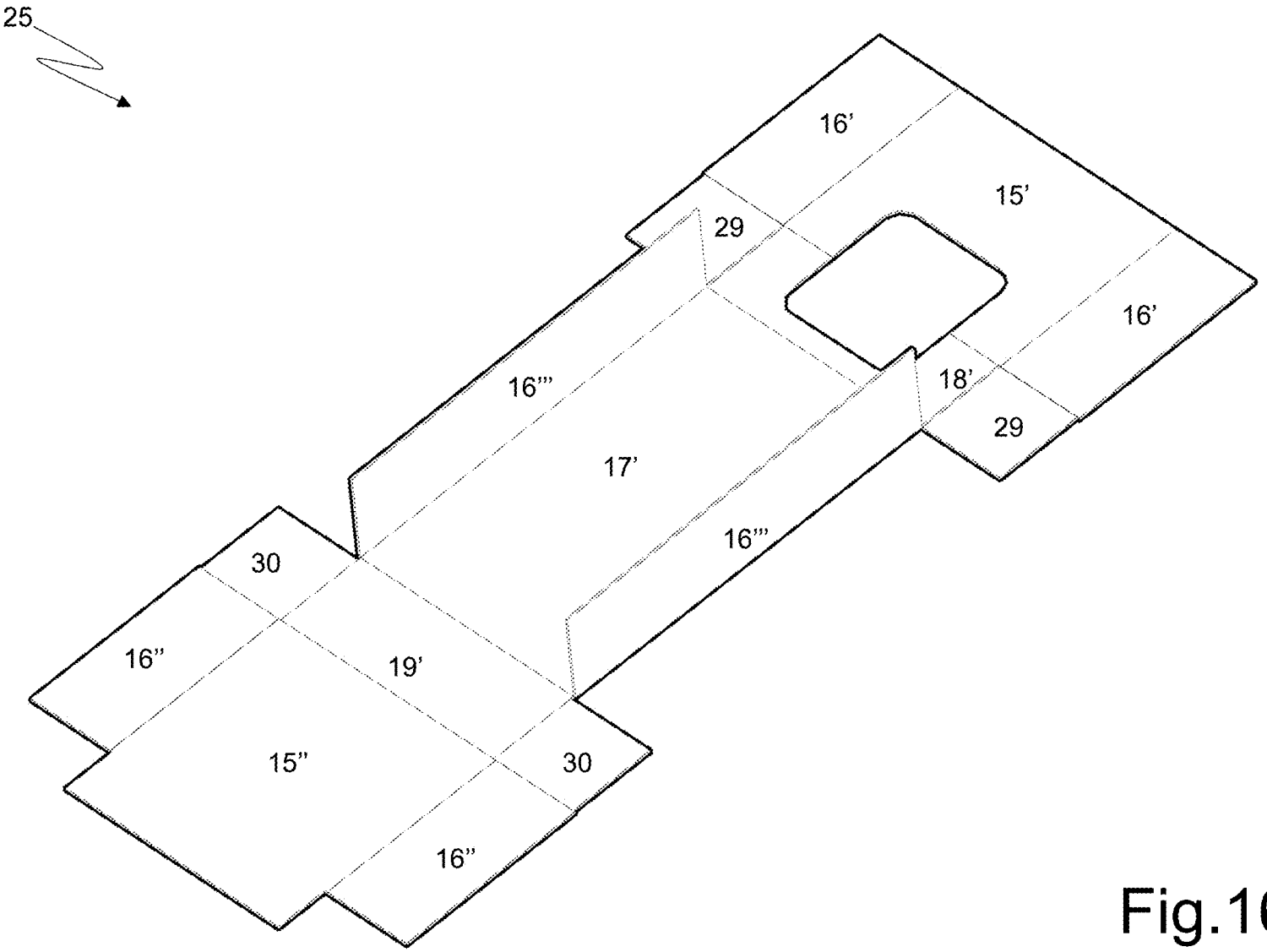
FIGS. 16-18 illustrates a perspective view of the folding of the blank of FIG. 15 to produce the inner container of FIG. 4.

In this embodiment, initially and as illustrated in FIG. 16, only the wings 16''' (completely devoid of flaps) are folded by 90° relative to the panel 17'.

Figure 17:
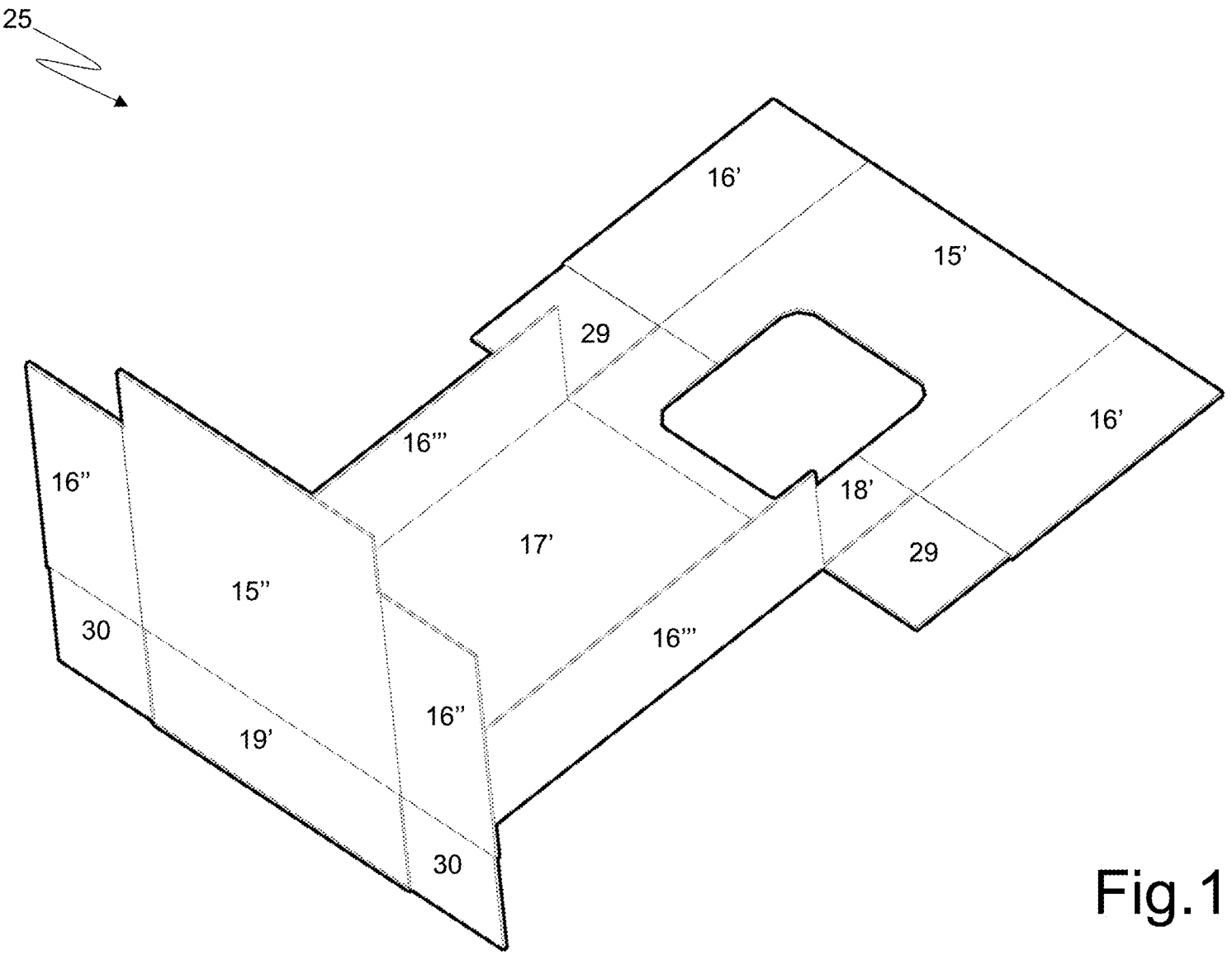

Subsequently and as illustrated in FIG. 17, the panel 19' (provided with the wings 30 and to which the panel 15", provided with the wings 16", is connected) is folded by 90° relative to the panel 17'; in this way the panel 15", provided with the wings 16" is arranged perpendicular to the panel 17'.

Figure 18:
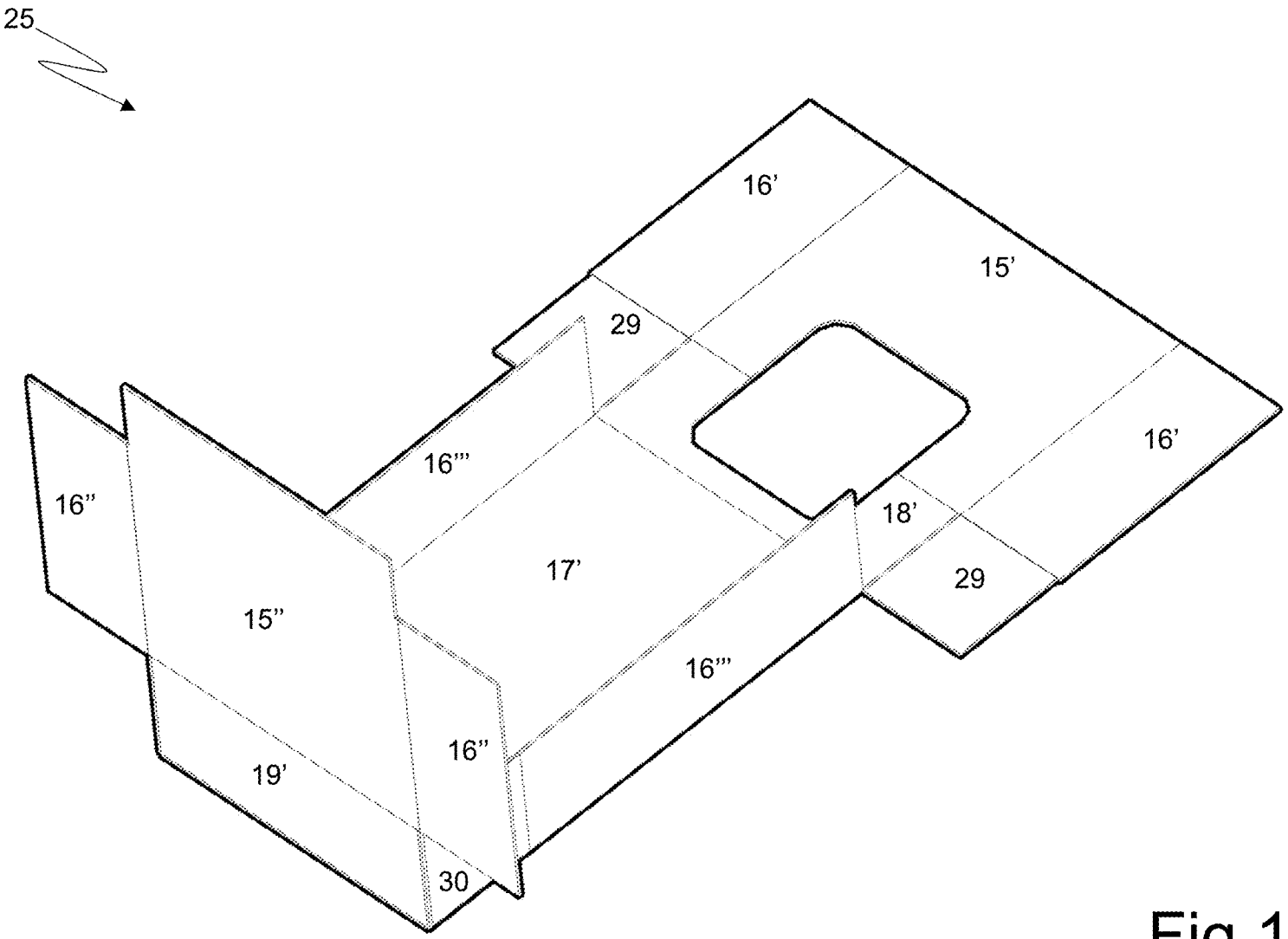

Subsequently and as illustrated in FIG. 18, the wings 30 are folded by 90° relative to the panel 19' and against the corresponding wings 16'''.

From this point on, the folding of the blank 25, illustrated in FIG. 15, continues in exactly the same manner as the folding of the blank 25 illustrated in FIG. 7.

According to a further embodiment, not illustrated, the wings 29 are arranged on opposite sides of the panel 18', are connected to the corresponding wings 16''' along a transverse folding line 27, and are folded by 90° relative to the corresponding wings 16''' so as to rest against the panel 18' (in this embodiment the wings 29 are much smaller so as not to interfere with the pull-out opening 20 when they are folded against the panel 18').

Figure 19:
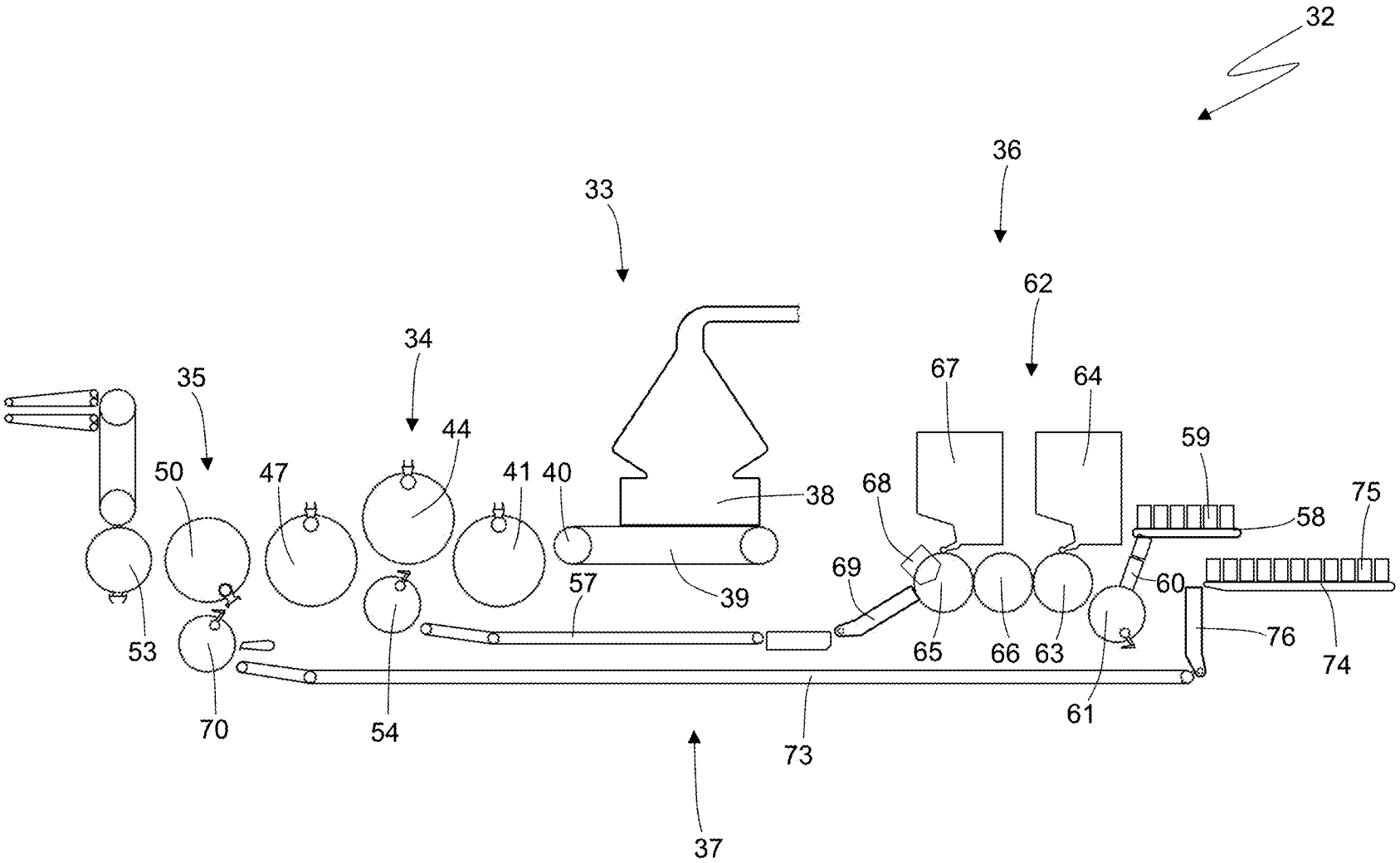
FIG. 19 is a front view of a packer machine which manufactures the pack of cigarettes of FIG. 1 and is produced according to the present invention.

In FIG. 19, number 32 denotes, as a whole, a packer machine which is adapted to produce the pack 1 of cigarettes described above.

The packer machine 32 comprises a forming unit 33 (known and only schematically illustrated in FIG. 19) in which the groups 23 of cigarettes are formed in succession, a wrapping unit 34 in which a blank 25 is folded around each group 23 of cigarettes to form the corresponding inner container 14, and a wrapping unit 35, in which a blank 24 is folded around each inner container 14 to form the corresponding outer container 2 provided with the hinged lid 4. A feeding unit 36 is coupled to the wrapping unit 34, which feeds the blanks 25 in succession, while a feeding unit 37 is coupled to the wrapping unit 35, which feeds the blanks 24 in succession.

The forming unit 33 comprises a hopper 38 provided with a plurality of outlet openings for feeding the groups 23 of cigarettes, a forming conveyor 39 provided with trains of pockets, each of which receives a group 23 of cigarettes from the hopper 38 and a transfer drum 40 which is mounted so as to rotate in a continuous manner and cyclically withdraws the groups 23 of cigarettes from the pockets of the forming conveyor 39 to transfer the groups 23 of cigarettes to the wrapping unit 34.

Figure 20:
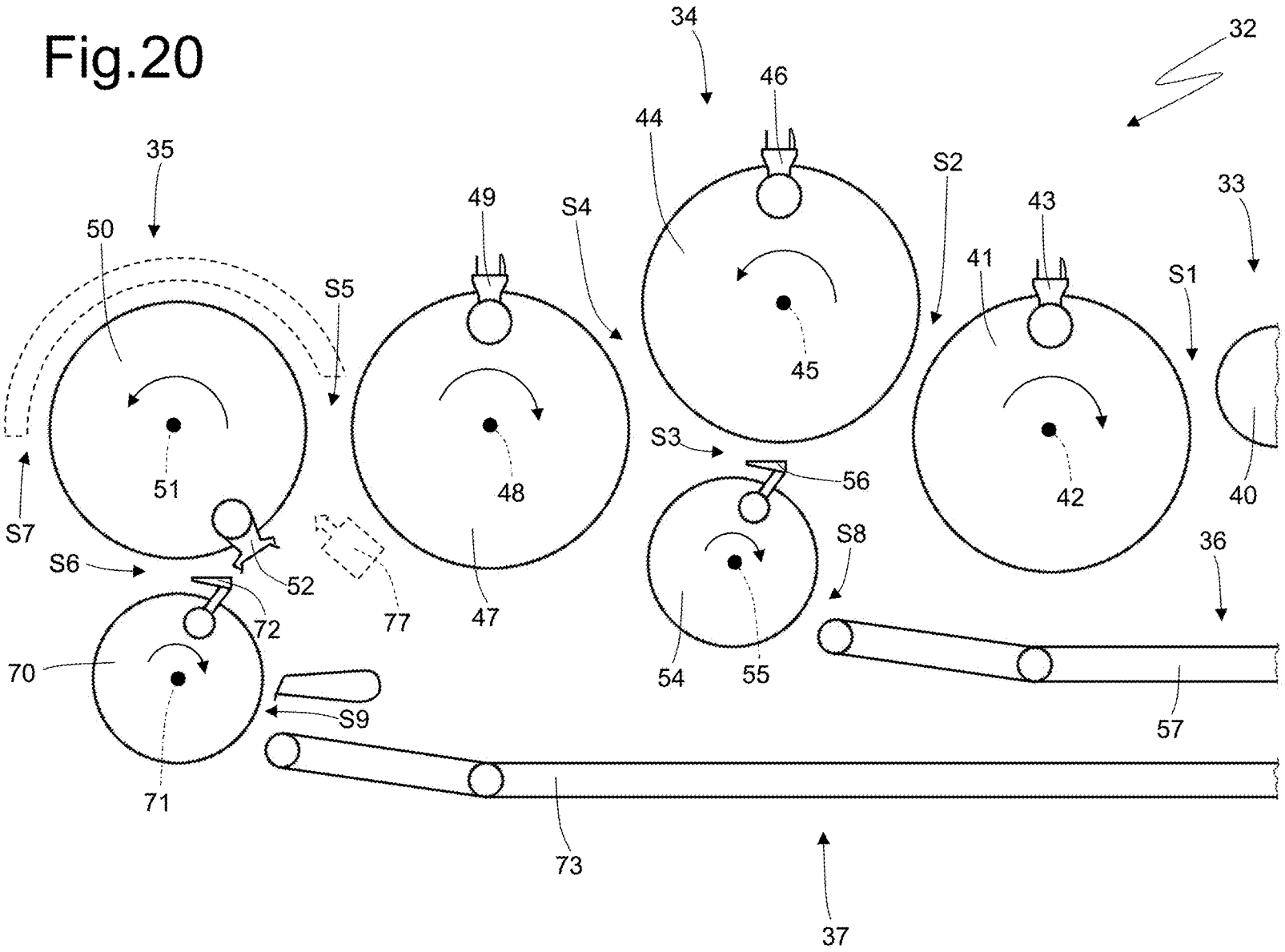
FIG. 20 is an enlarged view of a portion of the packer machine of FIG. 19.

As better illustrated in FIG. 20, the wrapping unit 34 comprises a transfer drum 41 which is mounted so as to rotate in a continuous manner about a horizontal rotation axis 42 (perpendicular to the plane of FIG. 16) and is provided with a plurality of transfer pockets 43 (only one of which is illustrated in the attached Figures for clarity), each of which is adapted to receive and hold a group 23 of cigarettes. The rotation of the transfer drum 41 about the rotation axis 42 carries each transfer pocket 43 through a transfer station S1 in which the transfer pocket 43 receives a group 23 of cigarettes from the transfer drum 40 of the forming unit 33 and a transfer station S2, in which the transfer pocket 43 releases the group 23 of cigarettes.

The wrapping unit 34 comprises a wrapping drum 44 which is mounted so as to rotate in a continuous manner about a horizontal rotation axis 45 (parallel to the rotation axis 42) and is provided with a plurality of wrapping pockets 46 (only one of which is illustrated in the attached Figures for clarity), each of which is adapted to receive and hold a blank 25 and subsequently a group 23 of cigarettes. The rotation of the wrapping drum 44 about the rotation axis 45 carries each wrapping pocket 46 through a feeding station S3 in which the wrapping pocket 46 receives a blank 25 from the feeding unit 36, subsequently through the transfer station S2 in which the wrapping pocket 46 receives a group 23 of cigarettes from the transfer drum 41, and finally through a transfer station S4 in which the wrapping pocket 46 releases the group 23 of cigarettes coupled to the blank 25. Each wrapping pocket 46 is provided with folding devices (better described in the following) which perform all the folding of the blank 25 around the group 23 of cigarettes.

The wrapping unit 34 comprises a wrapping drum 47 which is mounted so as to rotate in a continuous manner about a horizontal rotation axis 48 (parallel to the rotation axis 45) and is provided with a plurality of wrapping pockets 49 (only one of which is illustrated in the attached Figures for clarity), each of which is adapted to receive and hold an inner container 14 (i.e. a group 23 of cigarettes completely wrapped in a blank 25). The rotation of the wrapping drum 47 about the rotation axis 48 carries each wrapping pocket 49 through the transfer station S4 in which the wrapping pocket 49 receives an inner container 14 from the wrapping drum 44 (the folding of the blank 25 around the group 23 of cigarettes is completed in the transfer station S4 wherein the entry of the wrapping drum 47 into the wrapping pocket 49 causes the folding by 90° of the wings 16' and of the wings 16'' against the wings 16''') and subsequently through a transfer station S5 in which the wrapping pocket 49 releases the inner container 14.

The wrapping unit 35 comprises a wrapping drum 50 which is mounted so as to rotate in a continuous manner about a horizontal rotation axis 51 (parallel to the rotation axis 48) and is provided with a plurality of wrapping pockets 52 (only one of which is illustrated in the attached Figures for clarity), each of which is adapted to receive and hold a blank 24 and therefore an inner container 14. The rotation of the wrapping drum 50 about the rotation axis 51 carries each wrapping pocket 52 through a feeding station S6, in which the wrapping pocket 52 receives a blank 24 from the feeding unit 37, thereafter through the transfer station S5, in which the wrapping pocket 52 receives an inner container 14 from the wrapping drum 47, and finally through a transfer station S7, in which the wrapping pocket 52 releases the inner container 14 coupled to the blank 24. Each wrapping pocket 52 is provided with folding devices which fold the blank 24 around the inner container 14. Moreover, around the wrapping drum 44 and between the transfer station S5 and the transfer station S7 further folding devices (external and independent of the wrapping drum 50 and schematically illustrated only with a dashed line) are arranged, which perform the folding of the blank 24 around the inner container 14.

The wrapping unit 35 comprises a wrapping drum 53 (illustrated only in FIG. 19) which is mounted so as to rotate in a continuous manner about a horizontal rotation axis (parallel to the rotation axis 51) and is provided with a plurality of wrapping pockets (only one of which is illustrated in FIG. 19 for clarity), each of which is adapted to receive and hold a pack 1 of cigarettes (i.e. an inner container 14 completely wrapped in a blank 24). The rotation of the wrapping drum 53 about its rotation axis carries each wrapping pocket through the transfer station S7 in which the wrapping pocket receives a pack 1 of cigarettes from the wrapping drum 50 (the folding of the blank 24 around the inner container 14 is completed in the transfer station S7 by folding the wings 9' and 13' by 90° against the previously folded wings 9'' and 13'').

Downstream of the wrapping drum 53, the packs 1 of cigarettes are transferred to a vertical outlet conveyor and then to a subsequent horizontal outlet conveyor.

As illustrated in FIG. 20, the feeding unit 36 comprises a feeding drum 54 which is mounted so as to rotate in a continuous manner about a horizontal rotation axis 55 (parallel to the rotation axis 45) and is provided with a plurality of feeding heads 56 (only one of which is illustrated in the attached Figures for clarity), each of which is adapted to receive and hold a blank 25. The rotation of the feeding drum 54 about the rotation axis 55 carries each feeding head 56 through a pick-up station S8 in which the feeding head 56 picks-up a blank 25 from a horizontal stack of blanks 25 and through the feeding station S3, in which the feeding head 56 releases the blank 25 to a wrapping pocket 46 of the wrapping drum 44. Furthermore, the feeding unit 36 comprises a horizontal feeding conveyor 57 which supports the horizontal stack of blanks 25 thus feeding the horizontal stack towards the pick-up station S8.

As illustrated in FIG. 19, the feeding unit 36 comprises a horizontal feeding conveyor 58 which supports a series of bundles 59 of blanks 25 and feeds the bundles 59 of blanks 25 to a vertical hopper 60 having an upper inlet opening in which the bundles 59 of blanks 25 are inserted in succession and a lower outlet opening from which the individual blanks 25 are cyclically extracted. A transfer drum 61 is arranged downstream of the hopper 60, which is mounted so as to rotate in a continuous manner about a horizontal rotation axis and is provided with a plurality of transfer heads (only one of which is illustrated in FIG. 19 for clarity), each of which is adapted to receive and hold a blank 25. The rotation of the transfer drum 61 around the rotation axis carries each transfer head to pick up an individual blank 25 from the outlet opening of the hopper 60 and then to release the blank 25 to a tab-sticking unit 62 in which a corresponding closing tab 21 is applied to each blank 25.

The tab-sticking unit 62 comprises a tab-sticking drum 63 which receives the blanks 25 from the transfer drum 61, a tab-sticking device 64 which is adapted to stick the closing tabs 21 onto the blanks 25 carried by the tab-sticking drum 63, a further tab-sticking drum 65, which receive the blanks 25 from the tab-sticking drum 63 by the interposition of a transfer drum 66, and a further tab-sticking device 67, which is adapted to stick the closing tabs 21 on the blanks 25 carried by the tab-sticking drum 65. The two tab-sticking devices 64 can be operated alternatively (while a tab-sticking device 64 works the other tab-sticking device 64 is still, for example to allow cleaning, adjustment or replacement manoeuvres of the belt containing the closing tabs 23) or the two tab-sticking devices 64 can be operated together (obviously at a half operating speed because each tab-sticking device 64 applies a closing tab 21 to every two blanks 25). According to a different embodiment, not illustrated, the tab-sticking unit comprises only the tab-sticking device 67 and the tab-sticking drum 65 (i.e. the tab-sticking device 64, the tab-sticking drum 63, and the transfer drum 66 are not provided).

It is important to note that each closing tab 21 is applied to the corresponding blank 25 when the blank 25 is completely extended; in this way it is possible to stick each closing tab 21 to the corresponding blank 25 with a very high precision (not having to "follow" three-dimensional shapes during the application) and with an optimal adhesion (when the blank 25 is completely extended, it is simple to exert a high pressure between the closing tab 21 and the blank 25 to favour optimal adhesion of the closing tab 21 to the blank 25).

According to a preferred embodiment, the tab-sticking unit 62 comprises a control and rejection device 68, which is adapted to optically detect (for example by means of a digital video camera) an image of each blank 25 at least at the closing tab 21 to check whether the closing tab 21 is present, has been correctly applied (i.e. in the desired position and without folds or anomalous orientations) and is free of defects; in case of missing, incorrectly arranged or defective closing tabs 21, the control and rejection device 68 rejects the corresponding blanks 25, i.e. extracts the corresponding blanks 25 from the production flow, directing the rejected blanks 25 to a collecting container. It is important to note that the control and rejection device 68 could control the blanks 25 only at the closing tab 21 or could also control the blanks 25 in their entirety. In the embodiment illustrated in the attached Figure, the control and rejection device 68 is coupled to the tab-sticking drum 65 downstream of the tab-sticking device 67; according to other embodiments not illustrated, the control and rejection device 68 could be arranged in a different position (again downstream of the tab-sticking device 67).

It is important to note that controlling each blank 25 before folding the blank 25 around the corresponding group 23 of cigarettes makes it possible to reject only the defective 25 blanks without having, at the same time, to also reject groups 23 of cigarettes (being free of defects) only because they are coupled with defective blanks 25. Thus, controlling each blank 25 before folding the blank 25 around the corresponding group 23 of cigarettes allows to significantly reduce the number of cigarettes being rejected.

The feeding unit 36 comprises a transfer device 69 which receives the blanks 25 (provided with the closing tabs 21) from the tab-sticking drum 62 of the tab-sticking unit 62, collects the blanks 25 forming corresponding stacks and then cyclically transfers the stacks of blanks 25 on the feeding conveyor 57 to replenish the horizontal stack fed by feeding conveyor 57 towards the pick-up station S8. In the embodiment illustrated in FIG. 18, the transfer device 69 comprises a stacking chamber which is hinged to rotate about a horizontal rotation axis between a receiving position (illustrated in FIG. 19) in which the blanks 25 are cyclically inserted on the inside of the stacking chamber by the tab-sticking drum 65 to form a stack and a release position (not illustrated) in which a stack of blanks 25 is extracted from the stacking chamber to be transferred to the feeding conveyor 57. According to a different embodiment not illustrated, the transfer device 69 comprises a horizontal stacking chamber which is vertically movable between a receiving position, in which the blanks 25 are cyclically inserted inside the stacking chamber to form a stack, and a release position, in which a stack of blanks 25 is extracted from the stacking chamber to be transferred to the feeding conveyor 57; preferably, in the receiving position, the stacking chamber is arranged above the feeding conveyor 57 and in the release position the stacking chamber is vertically aligned with the feeding conveyor 57 (i.e. the stacking chamber is lowered with a vertical movement to move from the receiving position to the release position). In this embodiment, furthermore, the transfer device 69 comprises a transfer drum (totally similar to the transfer drum 61) which cyclically picks-up the individual blanks 25 from the tab-sticking drum 65 and deposits the individual blanks 25 in the stacking chamber.

As illustrated in FIG. 20, the feeding unit 37 comprises a feeding drum 70 which is mounted so as to rotate in a continuous manner about a horizontal rotation axis 71 (parallel to the rotation axis 51) and is provided with a plurality of feeding heads 72 (only one of which is illustrated in the attached Figures for clarity), each of which is adapted to receive and hold a blank 24. The rotation of the feeding drum 70 about the rotation axis 71 carries each feeding head 72 through a pick-up station S9, in which the feeding head 72 picks-up a blank 24 from the pocket of a horizontal stack of blanks 24 and through the feeding station S6, in which the feeding head 72 transfers the blank 24 to a wrapping pocket 52 of a wrapping drum 50. Furthermore, the feeding unit 37 comprises a horizontal feeding conveyor 73 which supports the horizontal stack of blanks 24, feeding the horizontal stack towards the pick-up station S9.

As illustrated in FIG. 19, the feeding unit 37 comprises a horizontal feeding conveyor 74 which supports a series of bundles 75 of blanks 24 and feeds the bundles 75 of blanks 24 to a transfer device 76 which cyclically transfers (by rotation) the bundles 75 of blanks 24 on the feeding conveyor 73 to replenish the horizontal stack fed by the feeding conveyor 73 towards the pick-up station S9.

As illustrated in FIG. 20, the wrapping unit 35 comprises a gluing device 77 (for example by spraying) which deposits the permanent glue 31 (for example quick-setting hot glue) on the panel 8' of the blank 24 so that the permanent glue 31 produces a permanent adhesion of the rear wall 8 of the outer container 2 to the rear wall 17 of the inner container 14 when the inner container 14 rests against the panel 8' of the blank 24 in the transfer station S5.

As previously stated, the inner container 14 is internally devoid of glue (i.e. no glue is used to connect parts of the inner container 14 together) and therefore in the wrapping unit 34 (i.e. at the wrapping drum 44 and at the wrapping drum 47) no gluing devices are provided as no glue is applied to the blank 25.

As illustrated in FIG. 20, the wrapping unit 35 only comprises the gluing device 77 which, in addition to applying the permanent glue 31 on each blank 24 for gluing the inner container 14 to the outer container 2, it also applies, to each blank 24 (in particular on the wings 9'or 9" and 13' or 13" of each blank 24), permanent glue which stabilizes the shape of the outer container 2 and of the lid 4.

According to an alternative embodiment, the gluing device 77 only applies the permanent glue which stabilizes the shape of the outer container 2 and of the lid 4 (i.e. does not apply the permanent glue 31 for gluing the inner container 14 to the outer container 2 and therefore the inner container 14 is not glued to the outer container 2).

According to a further embodiment not illustrated, the gluing device 77 only applies the permanent glue 31 for gluing the inner container 14 to the outer container 2 and a further gluing device is provided (separate and independent of the gluing device 77) which is arranged around the wrapping drum 50 near the transfer station S7 and is adapted to apply, on the blank 24, the permanent glue, which stabilizes the shape of the outer container 2 and of the lid 4. In fact, as previously stated, the folding of the blank 24 around the inner container 14 is completed in the transfer station S7 by folding the wings 9' and 13' by 90° against the previously folded wings 9" and 13"; consequently, the gluing (i.e. the application of glue) on the wings 9' or 9" and 13' or 13" of the blank 24 takes place immediately before the folding of the wings 9' and 13' against the wings 9" and 13" (i.e. immediately before the transfer station S7).

Figure 21:
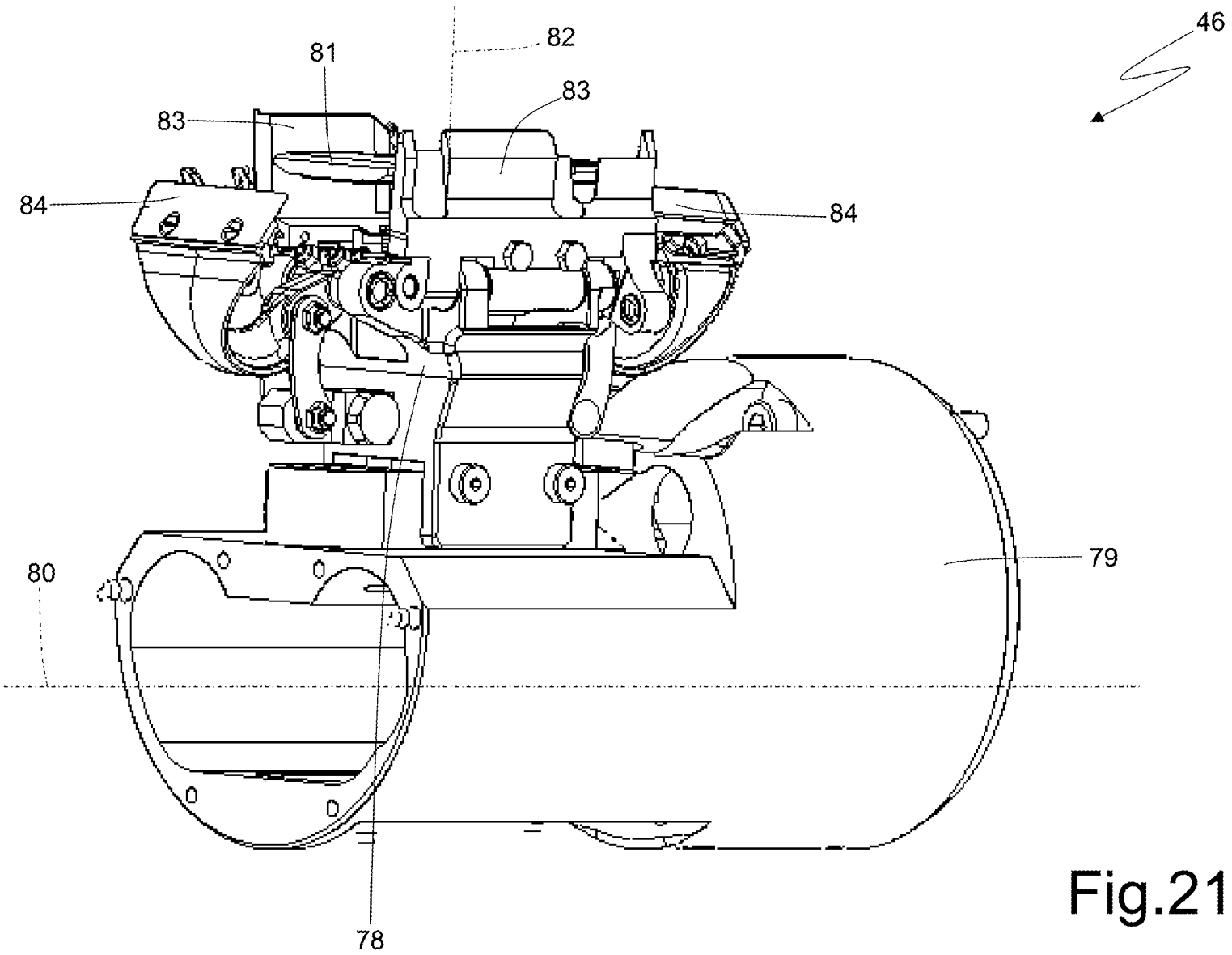
FIGS. 21 and 22 are two different perspective views and with the removal of parts for clarity of a wrapping pocket of a wrapping drum of the packer machine of FIG. 19.
Figure 22:
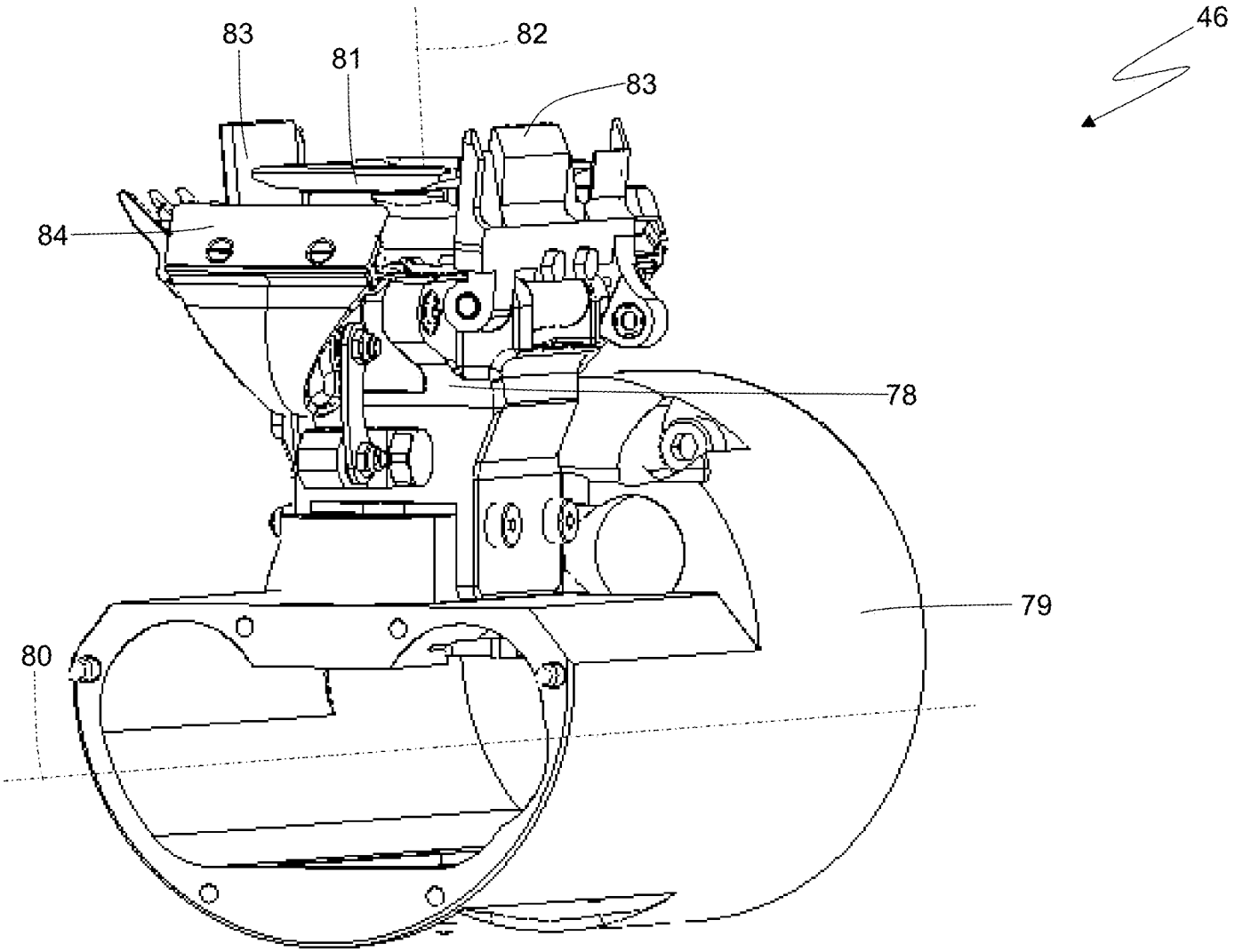

As illustrated in FIGS. 21 and 22, each wrapping pocket 46 comprises a main body 78 that is rigidly mounted on a support head 79, which is connected to the wrapping drum 44 in a rotary manner so as to rotate about a rotation axis 80 (parallel to the rotation axis 45 of the wrapping drum 44) under the control of a cam actuating system.

Figure 23:
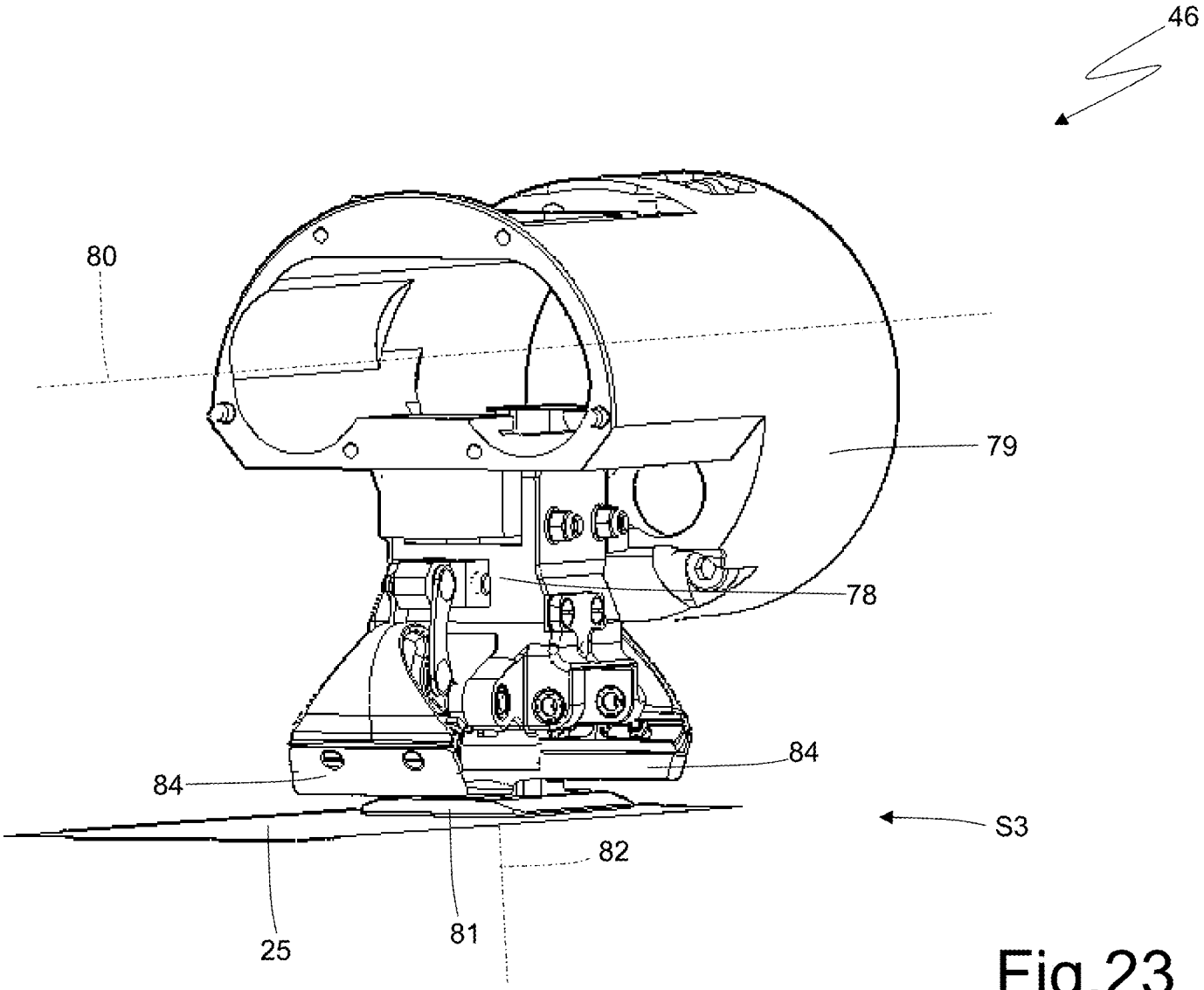
FIG. 23 is a perspective view and with the removal of parts for clarity of the feeding of the blank of FIG. 7 in the wrapping pocket of FIGS. 21 and 22.

A base 81 is mounted on the main body 78 of each wrapping pocket 46, which is arranged parallel to the rotation axis 45 of the wrapping drum 44 and is provided with suction to hold a corresponding blank 25 by way of suction; in particular, the base 81 has approximately the size of the panel 17' of the blank 25 and in use engages (by suction) the panel 17' of the blank 25. The base 81 is mounted on the main body 78 in a radially sliding manner, i.e. it is adapted to slide (under the control of a cam actuating system) relative to the main body 78 along a radial sliding direction 82 (i.e. perpendicular to the rotation axis 45 of the wrapping drum 44) between a retracted position (not illustrated) and an extracted position (illustrated in FIGS. 23 and 24).

On the main body 78 of each wrapping pocket 46, two side walls 83 are mounted, which are arranged on opposite sides of the base 81 and are hinged to the main body 78 to rotate (under the control of a cam actuating system) about two corresponding rotation axes parallel to the rotation axis 45 of the wrapping drum 44 between a raised position (illustrated in FIGS. 21 and 22), wherein the two side walls 83 are perpendicular to the base 81 and a lowered position (not illustrated), wherein the two side walls 83 are parallel to the base 81 (or slightly inclined relative to the base 81).

On the main body 78 of each wrapping pocket 46, two containment plates 84 are mounted, which are orientated perpendicularly to the two side walls 83 and are hinged to the main body 78 to rotate (under the control of a cam actuating system) around two corresponding rotation axes perpendicular to the rotation axis 45 of the wrapping drum 44 between a rest position (illustrated in FIGS. 21 and 22) wherein the two containment plates 84 are relatively far away from the base 81 and an operative position (not illustrated) wherein the two containment plates 84 are arranged at the base 81. According to a preferred embodiment illustrated in the attached Figures, each containment plate 84 is hinged to the main body 78 by means of a "U"-shaped arm which rigidly supports the containment plate 84 at one end and is hinged to the main body 78 at the opposite end.

Figure 24:
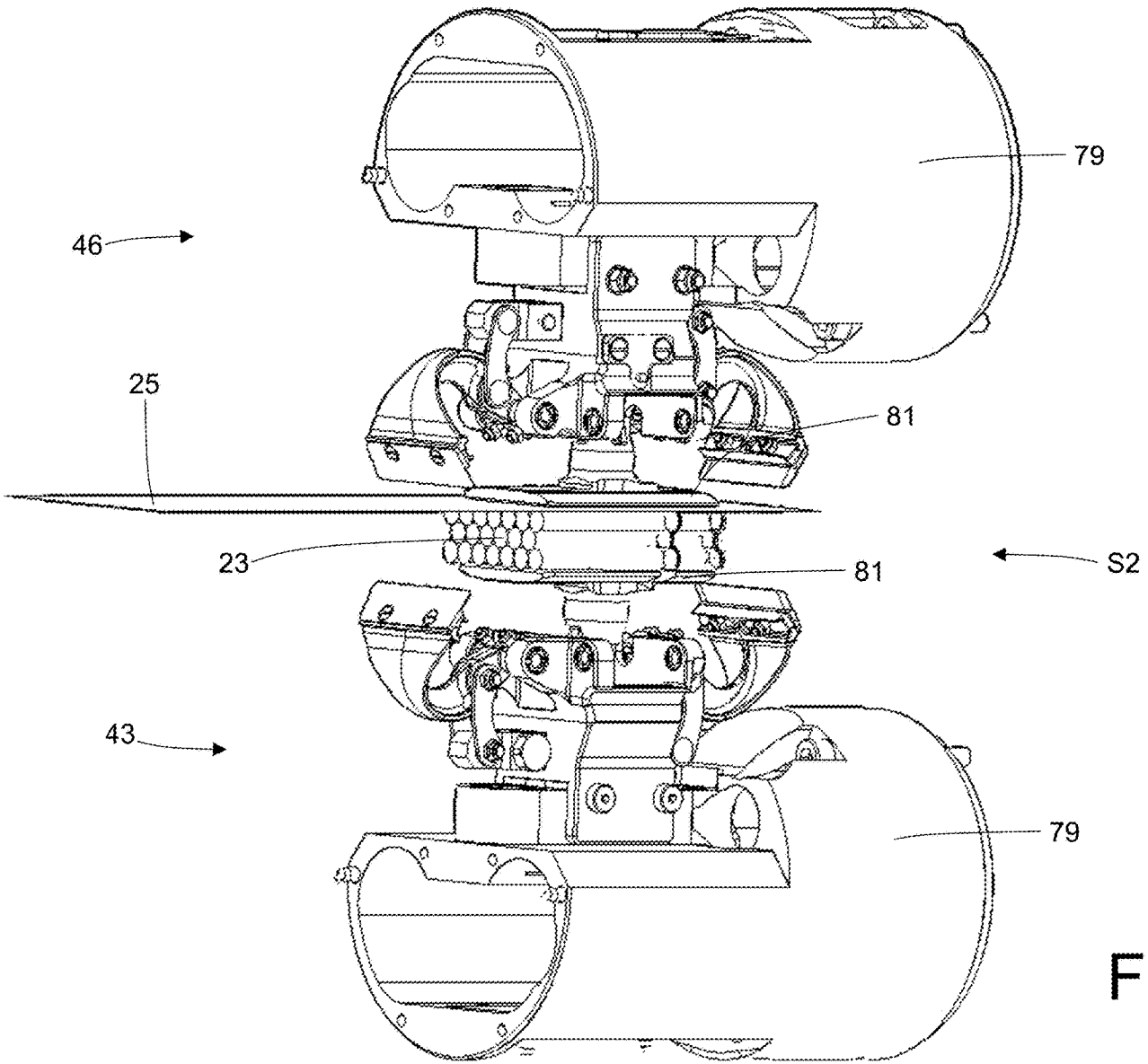
FIG. 24 is a perspective view and with the removal of parts for clarity of the transfer of a group of cigarettes into the wrapping pocket of FIGS. 21 and 22.

As illustrated in FIG. 24 (wherein part of the transfer station S2 is illustrated during the transfer of a group 23 of cigarettes from a transfer pocket 43 of the transfer drum 41 to a wrapping pocket 46 of the wrapping drum 44), each transfer pocket 43 of the transfer drum 41 is completely identical to the wrapping pockets 46 of the wrapping drum 44 (and therefore, in fact, also the transfer drum 41 is identical to the wrapping drum 44, although having a different role, as the transfer drum 41 limits the movement of the groups 23 of cigarettes from the transfer station S1 to the transfer station S2, whereas in the wrapping drum 44, during the movement of the groups 23 of cigarettes from the transfer station S2 to the transfer station S3, the folding of the blanks 25 around the groups 23 of cigarettes is performed). This design choice allows to lower the production costs of the packer machine 32 as it allows to considerably reduce the number of different pieces of which the packer machine 32 is formed.

Again for simplicity and economy of construction, also each wrapping pocket 49 of the wrapping drum 47 is completely identical to the wrapping pockets 46 of the wrapping drum 44, while each wrapping pocket 52 of the wrapping drum 50 is very similar but not completely identical to the wrapping pockets 46 of the wrapping drum 44, since around the wrapping drum 50 the blanks 24 are folded, which are different from the blanks 25 that are folded around the wrapping drum 44.

As will be described hereinafter, in each wrapping pocket 46 the two side walls 83 form folding devices (carried by the wrapping pocket 46), which perform the folding of the wings 16"' relative to the panel 17' and the two containment plates 84 form the folding devices (carried by the wrapping pocket 46), which perform the folding of the panels 19' e 18' relative to the panel 17' and the folding of the panels 15' e 15" relative to the panels 18' e 19'.

According to a preferred embodiment, when a blank 25 is fed (at the feeding station S3) to a wrapping pocket 46, the base 81 of the wrapping pocket 46 is in the extracted position (also illustrated in FIG. 23 wherein the feeding of the blank 25 to the wrapping pocket 46 is shown) so as to receive the blank 25 (in particular the base 81 rests against the panel 17' of the blank 25) and to hold the blank 25 by suction. Once the wrapping pocket 46 has picked-up a blank 25 in the feeding station S3, the wrapping pocket 46 moves towards the transfer station S2 in which it also receives the group 23 of cigarettes from a transfer pocket 43 of the transfer drum 41 (as illustrated in FIG. 24).

In the transfer station S2 (as illustrated in FIG. 24), the bases 81 of both the pockets 43 and 46 are in the extracted position so that the group 23 of cigarettes carried by the transfer pocket 43 of the transfer drum 41 can be released to the wrapping pocket 46 of the wrapping drum 44 (there is a moment, illustrated in FIG. 24, wherein the group 23 of cigarettes is engaged by both bases 81). Upstream of the transfer station S2 and in the transfer pocket 43 of transfer drum 41, the side walls 83 (not illustrated for clarity in FIG. 24) are in the raised position and the containment plates 84 are in the operative position to hold the group 23 of cigarettes thus maintaining the shape of the group 23 of cigarettes unaltered; in the feeding station S3 and in the transfer pocket 43 of the transfer drum 41, the side walls 83 (not illustrated for clarity in FIG. 24) are moved to the lowered position and the containment plates 84 are moved to the rest position to release the group 23 of cigarettes and thus allowing the group 23 of cigarettes to be transferred into the wrapping pocket 46 of the wrapping drum 44.

In the transfer station S2 and after the group 23 of cigarettes has been placed resting against (with the interposition of the blank 25) the base 81 of the wrapping pocket 46 of the wrapping drum 44, the base 81 itself moves from the extracted position to the retracted position and, at the same time, the side walls 83 move from the lowered position to the raised position to fold the two wings 16''' of the blank 25 by 90° relative to the panel 17' and against the group 23 of cigarettes; in other words, the first folding of each blank 25 (as illustrated in FIGS. 8 and 16) takes place in the transfer station S2 and around the group 23 of cigarettes, which rests against the panel 17', by means of the two side walls 83 which act as folding devices. It is important to note that the group 23 of cigarettes is rested against the panel 17' of the blank 25 when the blank 25 is still (substantially) flat; in this way the group 23 of cigarettes is not subjected to anomalous stresses (since it cannot "bump" against already folded parts of the blank 25) and can be placed, with great precision, resting against the blank 25 itself.

The wrapping drum 44 is provided with folding devices (mounted on the wrapping pockets 46) which, between the transfer station S2 and the transfer station S4 and for each blank 25, fold the panel 19' by 90° relative to the panel 17' (as illustrated in FIGS. 10 and 17), fold the panel 15" by 90° relative to the panel 19' (as illustrated in FIG. 11), fold the panel 18' by 90° relative to the panel 17' (as illustrated in FIG. 12), and fold the panel 15' by 90° relative to the panel 18' (as illustrated in FIG. 14); these folding devices are the two containment plates 84 of each wrapping pocket 46 which, by moving from the rest position to the operative position, perform all the folding described above, i.e. they perform the folding of the panels 19' and 18' relative to the panel 17' and the subsequent folding of the panels 15' and 15" relative to panels 18' and 19'.

As previously stated, for each blank 25 the wings 16' and the wings 16" are folded by 90° and against the wings 16''' completing the formation of the inner container 14 in the transfer station S4 during the passage of the inner container 14 from the wrapping pocket 46 of the wrapping drum 44 to the wrapping pocket 49 of the wrapping drum 47.

The wrapping drum 44 is provided with folding devices (mounted on the wrapping pockets 46) which, between the transfer station S2 and the transfer station S4 and for each blank 25, fold the wings 29 by 90° relative to the panel 18' (as illustrated in FIG. 13) and against the wings 16''' after having folded the panel 18' by 90° relative to the panel 17' (as illustrated in FIG. 12) and before folding the panel 15' by 90° relative to the panel 18' (as illustrated in FIG. 14); according to a preferred embodiment, these folding devices (not illustrated) are mounted (hinged) on a containment plate 84 of each wrapping pocket 46 or, alternatively, they are mounted (hinged) on the support head 79 of each wrapping pocket 46.

According to the embodiment illustrated in FIGS. 8-14, the wrapping drum 44 is provided with folding devices (mounted on the wrapping pockets 46) which, between the feeding station S3 and the transfer station S4 (preferably the feeding station S3 and the transfer station S2) and for each blank 25, fold the wings 30 by 90° relative to the corresponding wings 16''' (as illustrated in FIG. 9) after having folded the wings 16" by 90° relative to the panel 17' (as illustrated in FIG. 8) and before folding the panel 19' by 90° relative to the panel 17' (as illustrated in FIG. 10); according to a preferred embodiment, these folding devices (not illustrated) are mounted (hinged) on both side walls 83 of each wrapping pocket 46.

According to the embodiment illustrated in FIGS. 15-18, the wrapping drum 44 is provided with folding devices (mounted on the wrapping pockets 46) which, between the transfer station S2 and the transfer station S4, fold by 90° the wings 30 relative to the panel 19' and against the wings 16''' (as illustrated in FIG. 18) after having folded the panel 19' by 90° relative to the panel 17' (as illustrated in FIG. 17) and before folding the panel 15" by 90° relative to panel 19' (as illustrated in FIG. 11); according to a preferred embodiment, these folding devices (not illustrated) are mounted (hinged) on a containment plate 84 of each wrapping pocket 46 or, alternatively, they are mounted (hinged) on the support head 79 of each wrapping pocket 46.

Figure 25:
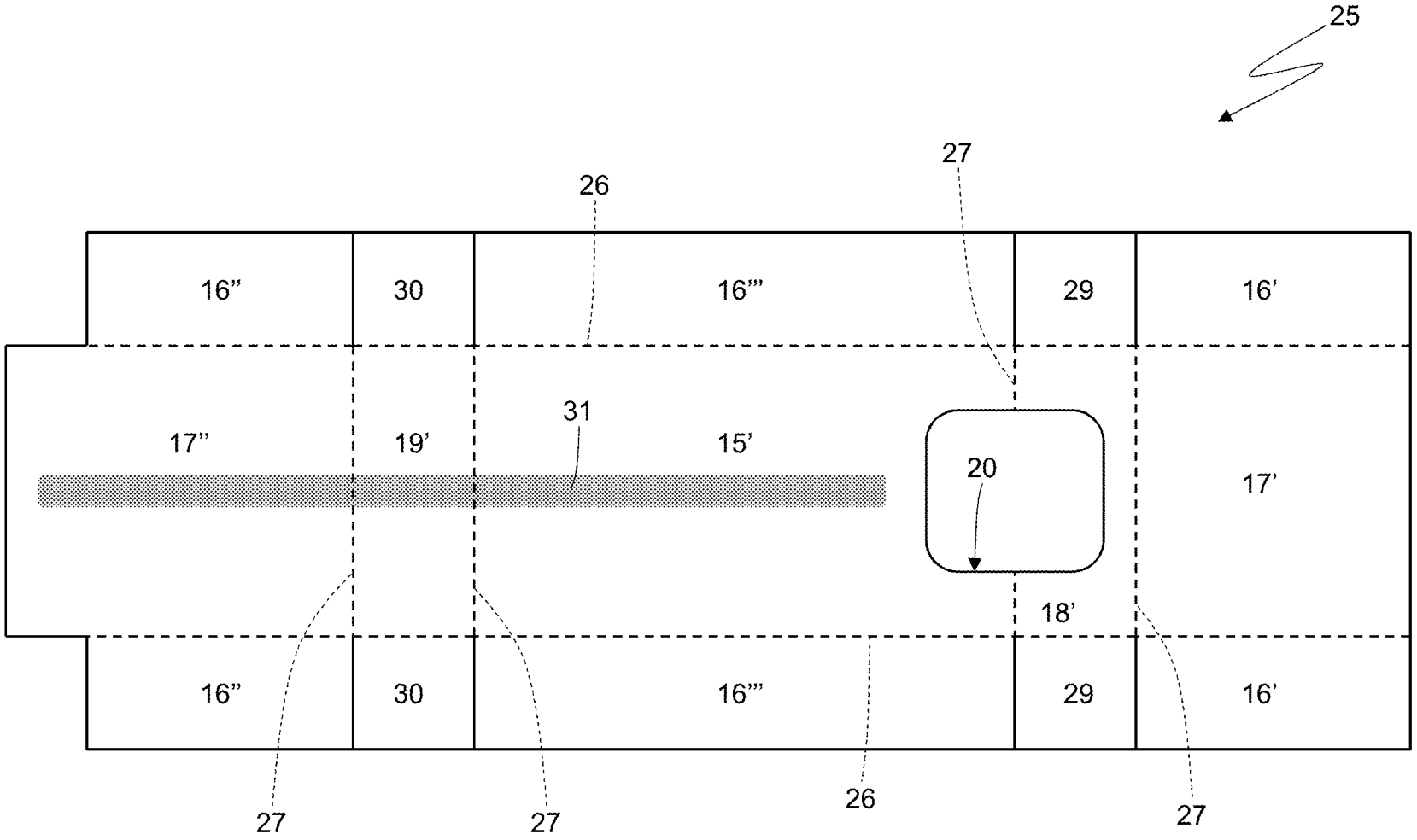
FIG. 25 is a plan view of a further alternative of the blank of FIG. 7.

In the embodiments illustrated in FIGS. 1-24, in the inner container 14 the rear wall 17 is formed by a single panel (the panel 17' of the blank 25) while the front wall 15 is formed by two panels (the panels 15' and 15" of the blank 25) arranged at the opposite ends of the blank 25. According to a different embodiment perfectly equivalent and illustrated in FIG. 25, in the inner container 14 the front wall 15 is formed by a single panel (the panel 15' of the blank 25) while the rear wall 17 is formed by two panels (the panels 17' and 17" of the blank 25) arranged at the opposite ends of the blank 25; in other words, in this embodiment in the blank 25 the position/configuration of the rear wall 17 is exchanged with the position/configuration of the front wall 15. Obviously, in this embodiment, in the feeding station S3 the panel 15' of the blank 25 rests against the base wall 81 of the corresponding wrapping pocket 46, and therefore in the transfer station S2 the group 23 of cigarettes rests against the panel 15' of the blank 25.

The embodiments described herein can be combined one with the other without departing from the scope of protection of the present invention.

The packer machine 32 described above has numerous advantages.

Firstly, the packer machine 32 described above allows to avoid the application of glue inside the inner containers 14 (i.e. in close proximity to the groups 23 of cigarettes) thus avoiding the risk of contaminating the cigarettes with traces of glue (both by direct contact of the cigarettes with the glue, and by absorption, by the cigarettes, of volatile substances released by the glue).

Furthermore, the packer machine 32 described above can operate with continuous motion (i.e. a motion devoid of stopping steps wherein the various moving parts move with a constant speed) which substantially reduces the mechanical stresses to which the cigarettes are subjected thus allowing to operate at a high hourly productivity (i.e. a high number of packs 1 of cigarettes produced per time unit) while maintaining, at the same time, an optimal production quality.

The packer machine 32 described above is compact and has an optimal accessibility to all its components; in fact, an operator who is in front of the packer machine 32 is able to reach, by hand, all the active parts of the packer machine 32 in a simple, fast and ergonomic manner.

The embodiment illustrated in the attached figures refers to the production of a pack of cigarettes, but the present invention can also be applied, without substantial modifications, to the production of any other type of pack of smoking articles (for example a pack of cigars, a pack of electronic cigarettes of the liquid vaporization type, a new generation pack of cigarettes without tobacco combustion . . . ).

Finally, the packer machine 32 described above can be easily modified to produce a standard pack of cigarettes (i.e. wherein the inner container 14 is replaced by a standard collar having only three walls, i.e. a front wall and two opposite side walls) simply by disabling (and possibly disassembling or removing) the feeding unit 36 which is replaced by a standard feeding unit, which feeds the standard collars at the transfer station S4. Accordingly, the packer machine 32 described above is very flexible as it can easily be adapted to produce different types of packs of cigarettes.

LIST OF THE REFERENCE NUMBERS OF THE FIGURES

1 pack of cigarettes
2 outer container
3 open upper end
4 lid
5 hinge
6 lower wall
7 front wall
8 rear wall
9 side walls
10 upper wall
11 front wall
12 rear wall
13 side walls
14 inner container
15 front wall
16 side walls
17 rear wall
18 upper wall
19 lower wall
20 pull-out opening
21 closing tab
22 connecting flap
23 group of cigarettes
24 blank
25 blank
26 longitudinal folding lines
27 transverse folding lines
28 wing
29 wing
30 wing
31 permanent glue
32 packer machine
33 forming unit
34 wrapping unit
35 wrapping unit
36 feeding unit
37 feeding unit
38 hopper
39 forming conveyor
40 transfer drum
41 transfer drum
42 rotation axis
43 transfer pocket
44 wrapping drum
45 rotation axis
46 wrapping pocket
47 wrapping drum
48 rotation axis
49 wrapping pocket
50 wrapping drum
51 rotation axis
52 wrapping pocket
53 wrapping drum
54 feeding drum
55 rotation axis
56 feeding head
57 feeding conveyor
58 feeding conveyor
59 bundles
60 hopper
61 transfer drum
62 tab-sticking unit
63 tab-sticking drum
64 tab-sticking device
65 tab-sticking drum
66 transfer drum
67 tab-sticking device
68 control and rejection device
69 transfer device
70 feeding drum
71 rotation axis
72 feeding head
73 feeding conveyor
74 feeding conveyor
75 bundles
76 transfer device
77 gluing device
78 main body
79 support head
80 rotation axis
81 base
82 flowing direction
83 side walls
84 containment plates
S1 transfer station
S2 transfer station
S3 feeding station
S4 transfer station
S5 transfer station
S6 feeding station
S7 transfer station S8 pick-up station S9 pick-up station

The invention claimed is:

1. A packer machine (32) to produce a pack (1) of smoking articles;

the pack (1) of smoking articles comprises: a group (23) of smoking articles; a rigid inner container (14), which is formed by folding a first blank (25), has a parallelepiped shape, encloses the group (23) of smoking articles on all six sides, and has a front wall (15), two side walls (16), a rear wall (17), an upper wall (18) and a lower wall (19); and an outer container (2), which is formed by folding a second blank (24), is provided with a hinged lid (4), and encloses the inner container (14);

the packer machine (32) comprises:

a first wrapping drum (44), which supports at least a first wrapping pocket (46), which is adapted to receive the first blank (25) and subsequently the group (23) of smoking articles;

a first feeding station (S3), in which the first blank (25) is inserted into the first wrapping pocket (46);

a first transfer station (S2), which is arranged downstream of the first feeding station (S3) and in which the group (23) of smoking articles is inserted into the first wrapping pocket (46) already containing the first blank (25);

a second wrapping drum (50), which supports at least a second wrapping pocket (52), which is adapted to receive the second blank (24) and subsequently the inner container (14);

a second feeding station (S6), in which the second blank (24) is inserted into the second wrapping pocket (52);

a second transfer station (S5), which is arranged downstream of the second feeding station (S6) and in which the inner container (14) is inserted into the second wrapping pocket (52) already containing the second blank (24); and a third wrapping drum (47), which supports at least a third wrapping pocket (49), which is adapted to directly receive the inner container (14) from the first wrapping pocket (46) in a third transfer station (S4), which is arranged between the first wrapping drum (44) and the third wrapping drum (47), and is adapted to directly release the inner container (14) to the second wrapping pocket (52) in the second transfer station (S5) which is arranged between the third wrapping drum (47) and the second wrapping drum (50);

wherein at the first wrapping drum (44) and at the third wrapping drum (47) no gluing devices are provided and, therefore, the inner container (14) is completely free from glue on the inside.

2. The packer machine (32) according to claim 1, further comprising a gluing device (77), which is arranged around the second wrapping drum (50) between the second feeding station (S6) and the second transfer station (S5) and is adapted to apply, on the second blank (24), permanent glue (31), which glues the outer container (2) to the inner container (14).

3. The packer machine (32) according to claim 1 wherein:

the first blank (25) comprises two longitudinal folding lines (26) and a plurality of transverse folding lines (27), which define, between the two longitudinal folding lines (26), a first panel (15'; 17'), which makes up an upper part of the front or rear wall (15; 17) of the inner container (14), a second panel (18'), which makes up the upper wall (18) of the inner container (14), a third panel (17' 15'), which makes up the rear or front wall (17; 15) of the inner container (14), a fourth panel (19'), which makes up the lower wall (19) of the inner container (14), and a fifth panel (15"; 17"), which makes up a lower part of the front or rear wall (15; 17) of the inner container (14);

the first blank (25) comprises a pair of first wings (16'), which are arranged on opposite sides of the first panel (15'; 17'), are connected to the first panel (15'; 17') along the two longitudinal folding lines (26), and make up part of the side walls (16) of the inner container (14);

the first blank (25) comprises a pair of second wings (16"), which are arranged on opposite sides of the fifth panel (15"; 17"), are connected to the fifth panel (15"; 17") along the two longitudinal folding lines (26), and make up part of the side walls (16) of the inner container (14);

the first blank (25) comprises a pair of third wings (16'''), which are arranged on opposite sides of the third panel (17'; 15'), are connected to the third panel (17'; 15') along the two longitudinal folding lines (26), and make up part of the side walls (16) of the inner container (14);

in the first transfer station (S2) the group (23) of cigarettes is laid on the third panel (17'; 15') of the first blank (25); and the first wrapping pocket (46) comprises first folding devices, which fold the two third wings (16''') by 90° relative to the third panel (17'; 15') at the first transfer station (S2).

4. The packer machine (32) according to claim 3, further comprising second folding devices, which, between the first transfer station (S2) and the third transfer station (S4), fold the fourth panel (19') by 90° relative to the third panel (17'; 15'), fold the fifth panel (15"; 17") by 90° relative to the fourth panel (19'), fold the second panel (18') by 90° relative to the third panel (17'; 15'), and fold the first panel (15'; 17') by 90° relative to the second panel (18').

5. The packer machine (32) according to claim 3, wherein the first wings (16') and the second wings (16") are folded by 90° and against the third wings (16''') thus completing the formation of the inner container (14) in the third transfer station (S4) during the passage of the inner container (14) from the first wrapping pocket (46) to the third wrapping pocket (49).

6. The packer machine (32) according to claim 3, wherein:

the first blank (25) comprises a pair of first wings (29), which are arranged on opposite sides of the second panel (18'), are connected to the second panel (18') along the two longitudinal folding lines (26), and are folded by 90° relative to the second panel (18') so as to rest against the third wings (16'''); and second folding devices are provided, which, between the first transfer station (S2) and the third transfer station (S4), fold the second panel (18') by 90° relative to the third panel (17'; 15'), fold the first wings (29) by 90° relative to the second panel (18') and against the third wings (16'''), and fold the first panel (15'; 17') by 90° relative to the second panel (18').

7. The packer machine (32) according to claim 3, wherein:

the first blank (25) comprises a pair of second wings (30), which are arranged on opposite sides of the fourth panel (19'), are connected to the corresponding third wings (16''') along a transverse folding line (27), and are folded by 90° relative to the corresponding third wings (16''') so as to rest against the fourth panel (19'); and second folding devices are provided, which, between the first transfer station (S2) and the third transfer station (S4), fold the second wings (30) by 90° relative to the corresponding third wings (16'''), fold the fourth panel (19') by 90° relative to the third panel (17'; 15') and against the second wings (30), fold the fifth panel (15''; 17'') by 90° relative to the fourth panel (19'), fold the second panel (18') by 90° relative to the third panel (17'; 15'), and fold the first panel (15'; 17') by 90° relative to the second panel (18').

8. The packer machine (32) according to claim 3, wherein:

the first blank (25) comprises a pair of second wings (30), which are arranged on opposite sides of the fourth panel (19'), are connected to the fourth panel (19') along the two longitudinal folding lines (26), and are folded by 90° relative to the fourth panel (19') so as to rest against the third wings (16'''); and second folding devices are provided, which, between the first transfer station (S2) and the third transfer station (S4), fold the fourth panel (19') by 90° relative to the third panel (17', 15'), fold the second wings (30) by 90° relative to the fourth panel (19') and against the third wings (16'''), fold the fifth panel (15''; 17'') by 90° relative to the fourth panel (19'), fold the second panel (18') by 90° relative to the third panel (17'; 15'), and fold the first panel (15'; 17') by 90° relative to the second panel (18').

9. The packer machine (32) according to claim 1, further comprising:

a first feeding unit (36), which comprises a first feeding drum (54), which is provided with at least a first feeding head (56), which receives the first blank (25) in a first pick-up station (S8) and releases the first blank (25) to the first wrapping pocket (46) in the first feeding station (S3); and a second feeding unit (37), which comprises a second feeding drum (70), which is provided with at least a second feeding head (72), which receives the second blank (24) in a second pick-up station (S9) and releases the second blank (24) to the second wrapping pocket (52) in the second feeding station (S6).

10. The packer machine (32) according to claim 9 wherein:

the first feeding unit (36) comprises a first horizontal feeding conveyor (57) which supports a first horizontal stack of first blanks (25), feeding the first horizontal stack towards the first pick-up station (S8); and the second feeding unit (37) comprises a second horizontal feeding conveyor (73), which is arranged under the first feeding conveyor (57) and supports a second horizontal stack of second blanks (24), feeding the second horizontal stack towards the second pick-up station (S9).

11. The packer machine (32) according to claim 1, further comprising a tab-sticking unit (62), which sticks a closing tab (21) on each first blank (25) at a pull-out opening (20), which is obtained through the front wall (15) of the inner container (14) and through the upper wall (18) of the inner container (14).

12. The packer machine (32) according to claim 11, wherein the tab-sticking unit (62) comprises:

a first tab-sticking drum (63), which is adapted to feed the first blanks (25);

a first tab-sticking device (64), which is adapted to stick the closing tabs (21) to the blanks (25) carried by the first tab-sticking drum (63);

a second tab-sticking drum (65), which receives the first blanks (25) from the first tab-sticking drum (63) and is adapted to feed the first blanks (25); and a second tab-sticking device (67), which is adapted to stick the closing tabs (21) to the first blanks (25) carried by the second tab-sticking drum (65).

13. The packer machine (32) according to claim 11, wherein the tab-sticking unit (62) comprises a control and rejection device (68), which is adapted to optically control each first blank (25) at least at the closing tab (21) and is adapted to reject possible non-compliant first blanks (25).

14. A wrapping method to produce a pack (1) of smoking articles using the packer machine of claim 1;

the wrapping method comprises the steps of:

inserting, in the first feeding station (S3), the first blank (25) into the first wrapping pocket (46) of the first wrapping drum (44);

inserting, in the first transfer station (S2), which is arranged downstream of the first feeding station (S3), the group (23) of smoking articles into the first wrapping pocket (46) already containing the first blank (25);

inserting, in the second feeding station (S6), the second blank (24) into the second wrapping pocket (52) of the second wrapping drum (50); and inserting, in the second transfer station (S5), which is arranged downstream of the second feeding station (S6), the inner container (14) into the second wrapping pocket (52) already containing the second blank (24);

inserting, in the third transfer station (S4), which is arranged between the first wrapping drum (44) and the third wrapping drum (47), the inner container (14) from the first wrapping pocket (46) directly to the third wrapping pocket (49) of the third wrapping drum (47); and releasing, in the second transfer station (S5), which is arranged between the third wrapping drum (47) and the second wrapping drum (50), the inner container (14) from the third wrapping pocket (49) directly to the second wrapping pocket (52).

15. A packer machine (32) to produce a pack (1) of smoking articles; the pack (1) of smoking articles comprises: a group (23) of smoking articles; a rigid inner container (14), which is formed by folding a first blank (25), has a parallelepiped shape, encloses the group (23) of smoking articles on all six sides, and has a front wall (15), two side walls (16), a rear wall (17), an upper wall (18) and a lower wall (19); and an outer container (2), which is formed by folding a second blank (24), is provided with a hinged lid (4), and encloses the inner container (14);

the packer machine (32) comprises:

a first wrapping drum (44), which supports at least a first wrapping pocket (46), which is adapted to receive the first blank (25) and subsequently the group (23) of smoking articles;

a first feeding station (S3), in which the first blank (25) is inserted into the first wrapping pocket (46);

a first transfer station (S2), which is arranged downstream of the first feeding station (S3) and in which the group (23) of smoking articles is inserted into the first wrapping pocket (46) already containing the first blank (25);

a second wrapping drum (50), which supports at least a second wrapping pocket (52), which is adapted to receive the second blank (24) and subsequently the inner container (14); a second feeding station (S6), in which the second blank (24) is inserted into the second wrapping pocket (52);

a second transfer station (S5), which is arranged downstream of the second feeding station (S6) and in which the inner container (14) is inserted into the second wrapping pocket (52) already containing the second blank (24); and a third wrapping drum (47), which supports at least a third wrapping pocket (49), which is adapted to directly receive the inner container (14) from the first wrapping pocket (46) in a third transfer station (S4), which is arranged between the first wrapping drum (44) and the third wrapping drum (47), and is adapted to directly release the inner container (14) to the second wrapping pocket (52) in the second transfer station (S5) which is arranged between the third wrapping drum (47) and the second wrapping drum (50);

wherein the first blank (25) comprises two longitudinal folding lines (26) and a plurality of transverse folding lines (27), which define, between the two longitudinal folding lines (26), a first panel (15'; 17'), which makes up an upper part of the front or rear wall (15; 17) of the inner container (14), a second panel (18'), which makes up the upper wall (18) of the inner container (14), a third panel (17' 15'), which makes up the rear or front wall (17; 15) of the inner container (14), a fourth panel (19'), which makes up the lower wall (19) of the inner container (14), and a fifth panel (15"; 17"), which makes up a lower part of the front or rear wall (15; 17) of the inner container (14);

wherein the first blank (25) comprises a pair of first wings (16'), which are arranged on opposite sides of the first panel (15'; 17'), are connected to the first panel (15'; 17') along the two longitudinal folding lines (26), and make up part of the side walls (16) of the inner container (14);

wherein the first blank (25) comprises a pair of second wings (16"), which are arranged on opposite sides of the fifth panel (15"; 17"), are connected to the fifth panel (15"; 17") along the two longitudinal folding lines (26), and make up part of the side walls (16) of the inner container (14);

wherein the first blank (25) comprises a pair of third wings (16'''), which are arranged on opposite sides of the third panel (17'; 15'), are connected to the third panel (17'; 15') along the two longitudinal folding lines (26), and make up part of the side walls (16) of the inner container (14); in the first transfer station (S2) the group (23) of cigarettes is laid on the third panel (17'; 15') of the first blank (25); and wherein the first wrapping pocket (46) comprises first folding devices, which fold the two third wings (16''') by 90° relative to the third panel (17'; 15') at the first transfer station (S2).

16. The packer machine (32) according to claim 15 and comprising second folding devices, which, between the first transfer station (S2) and the third transfer station (S4), fold the fourth panel (19') by 90° relative to the third panel (17'; 15'), fold the fifth panel (15"; 17") by 90° relative to the fourth panel (19'), fold the second panel (18') by 90° relative to the third panel (17'; 15'), and fold the first panel (15'; 17') by 90° relative to the second panel (18').

17. The packer machine (32) according to claim 15, wherein the first wings (16') and the second wings (16") are folded by 90° and against the third wings (16") thus completing the formation of the inner container (14) in the third transfer station (S4) during the passage of the inner container (14) from the first wrapping pocket (46) to the third wrapping pocket (49).

18. The packer machine (32) according to claim 15, wherein:

the first blank (25) comprises a pair of first wings (29), which are arranged on opposite sides of the second panel (18'), are connected to the second panel (18') along the two longitudinal folding lines (26), and are folded by 90° relative to the second panel (18') so as to rest against the third wings (16'''); and second folding devices are provided, which, between the first transfer station (S2) and the third transfer station (S4), fold the second panel (18') by 90° relative to the third panel (17'; 15'), fold the first wings (29) by 90° relative to the second panel (18') and against the third wings (16'''), and fold the first panel (15'; 17') by 90° relative to the second panel (18').

19. The packer machine (32) according to claim 15, wherein:

the first blank (25) comprises a pair of second wings (30), which are arranged on opposite sides of the fourth panel (19'), are connected to the corresponding third wings (16''') along a transverse folding line (27), and are folded by 90° relative to the corresponding third wings (16''') so as to rest against the fourth panel (19'); and second folding devices are provided, which, between the first transfer station (S2) and the third transfer station (S4), fold the second wings (30) by 90° relative to the corresponding third wings (16'''), fold the fourth panel (19') by 90° relative to the third panel (17'; 15') and against the second wings (30), fold the fifth panel (15"; 17") by 90° relative to the fourth panel (19'), fold the second panel (18') by 90° relative to the third panel (17'; 15'), and fold the first panel (15'; 17') by 90° relative to the second panel (18').

20. A packer machine (32) to produce a pack (1) of smoking articles; the pack (1) of smoking articles comprises: a group (23) of smoking articles; a rigid inner container (14), which is formed by folding a first blank (25), has a parallelepiped shape, encloses the group (23) of smoking articles on all six sides, and has a front wall (15), two side walls (16), a rear wall (17), an upper wall (18) and a lower wall (19); and an outer container (2), which is formed by folding a second blank (24), is provided with a hinged lid (4), and encloses the inner container (14);

the packer machine (32) comprises:

a first wrapping drum (44), which supports at least a first wrapping pocket (46), which is adapted to receive the first blank (25) and subsequently the group (23) of smoking articles;

a first feeding station (S3), in which the first blank (25) is inserted into the first wrapping pocket (46);

a first transfer station (S2), which is arranged downstream of the first feeding station (S3) and in which the group (23) of smoking articles is inserted into the first wrapping pocket (46) already containing the first blank (25);

a second wrapping drum (50), which supports at least a second wrapping pocket (52), which is adapted to receive the second blank (24) and subsequently the inner container (14); a second feeding station (S6), in which the second blank (24) is inserted into the second wrapping pocket (52);

a second transfer station (S5), which is arranged downstream of the second feeding station (S6) and in which the inner container (14) is inserted into the second wrapping pocket (52) already containing the second blank (24);

a third wrapping drum (47), which supports at least a third wrapping pocket (49), which is adapted to directly receive the inner container (14) from the first wrapping pocket (46) in a third transfer station (S4), which is arranged between the first wrapping drum (44) and the third wrapping drum (47), and is adapted to directly release the inner container (14) to the second wrapping pocket (52) in the second transfer station (S5) which is arranged between the third wrapping drum (47) and the second wrapping drum (50);

a first feeding unit (36), which comprises a first feeding drum (54), which is provided with at least a first feeding head (56), which receives the first blank (25) in a first pick-up station (S8) and releases the first blank (25) to the first wrapping pocket (46) in the first feeding station (S3); and a second feeding unit (37), which comprises a second feeding drum (70), which is provided with at least a second feeding head (72), which receives the second blank (24) in a second pick-up station (S9) and releases the second blank (24) to the second wrapping pocket (52) in the second feeding station (S6).

21. The packer machine (32) according to claim 20 wherein:

the first feeding unit (36) comprises a first horizontal feeding conveyor (57) which supports a first horizontal stack of first blanks (25), feeding the first horizontal stack towards the first pick-up station (S8); and the second feeding unit (37) comprises a second horizontal feeding conveyor (73), which is arranged under the first feeding conveyor (57) and supports a second horizontal stack of second blanks (24), feeding the second horizontal stack towards the second pick-up station (S9).

22. A packer machine (32) to produce a pack (1) of smoking articles; the pack (1) of smoking articles comprises: a group (23) of smoking articles; a rigid inner container (14), which is formed by folding a first blank (25), has a parallelepiped shape, encloses the group (23) of smoking articles on all six sides, and has a front wall (15), two side walls (16), a rear wall (17), an upper wall (18) and a lower wall (19); and an outer container (2), which is formed by folding a second blank (24), is provided with a hinged lid (4), and encloses the inner container (14);

the packer machine (32) comprises:

a first wrapping drum (44), which supports at least a first wrapping pocket (46), which is adapted to receive the first blank (25) and subsequently the group (23) of smoking articles;

a first feeding station (S3), in which the first blank (25) is inserted into the first wrapping pocket (46);

a first transfer station (S2), which is arranged downstream of the first feeding station (S3) and in which the group (23) of smoking articles is inserted into the first wrapping pocket (46) already containing the first blank (25);

a second wrapping drum (50), which supports at least a second wrapping pocket (52), which is adapted to receive the second blank (24) and subsequently the inner container (14); a second feeding station (S6), in which the second blank (24) is inserted into the second wrapping pocket (52);

a second transfer station (S5), which is arranged downstream of the second feeding station (S6) and in which the inner container (14) is inserted into the second wrapping pocket (52) already containing the second blank (24);

a third wrapping drum (47), which supports at least a third wrapping pocket (49), which is adapted to directly receive the inner container (14) from the first wrapping pocket (46) in a third transfer station (S4), which is arranged between the first wrapping drum (44) and the third wrapping drum (47), and is adapted to directly release the inner container (14) to the second wrapping pocket (52) in the second transfer station (S5) which is arranged between the third wrapping drum (47) and the second wrapping drum (50); and a tab-sticking unit (62), which sticks a closing tab (21) on each first blank (25) at a pull-out opening (20), which is obtained through the front wall (15) of the inner container (14) and through the upper wall (18) of the inner container (14).

23. The packer machine (32) according to claim 22, wherein the tab-sticking unit (62) comprises: a first tab-sticking drum (63), which is adapted to feed the first blanks (25); a first tab-sticking device (64), which is adapted to stick the closing tabs (21) to the blanks (25) carried by the first tab-sticking drum (63); a second tab-sticking drum (65), which receives the first blanks (25) from the first tab-sticking drum (63) and is adapted to feed the first blanks (25); and a second tab-sticking device (67), which is adapted to stick the closing tabs (21) to the first blanks (25) carried by the second tab-sticking drum (65).

24. The packer machine (32) according to claim 22, wherein the tab-sticking unit (62) comprises a control and rejection device (68), which is adapted to optically control each first blank (25) at least at the closing tab (21) and is adapted to reject possible non-compliant first blanks (25).

* * * * *